US012768605B2

(12) United States Patent
Hanley et al.

(10) Patent No.: US 12,768,605 B2
(45) Date of Patent: Oct. 20, 2026

(54) METHOD OF CONTROLLING LANCE MOVEMENT THROUGH HEATER EXCHANGER ASSEMBLIES

(71) Applicant: Stoneage, Inc., Durango, CO (US)

(72) Inventors: Cooper Hanley, Durango, CO (US); Daniel Szabo, Durango, CO (US)

(73) Assignee: STONEAGE, INC, Durango, CO (US)

( * ) Notice: Subject to any disclaimer, the term of this patent is extended or adjusted under 35 U.S.C. 154(b) by 51 days.

(21) Appl. No.: 19/057,343

(22) Filed: Feb. 19, 2025

(65) Prior Publication Data

US 2026/0243529 A1 Aug. 20, 2026

(51) Int. Cl.

| | |
|---|---|
| ***F28G 15/00*** | (2006.01) |
| ***F28G 9/00*** | (2006.01) |
| ***F28G 15/04*** | (2006.01) |

(52) U.S. Cl.

CPC ..... *F28G 15/003* (2013.01); *F28G 9/00* (2013.01); *F28G 15/04* (2013.01)

(58) Field of Classification Search

None

See application file for complete search history.

(56) References Cited

U.S. PATENT DOCUMENTS

| | | | |
|---|---|---|---|
| 3,354,490 | A | 11/1967 | Masters et al. |
| 3,665,608 | A | 5/1972 | Stockebrand |
| 3,794,051 | A | 2/1974 | Lee et al. |
| 3,821,498 | A | 6/1974 | Schaefer et al. |
| 3,901,252 | A | 8/1975 | Riebe |
| 3,903,912 | A | 9/1975 | Ice, Jr. et al. |
| 4,001,556 | A | 1/1977 | Folchi et al. |
| 4,137,928 | A | 2/1979 | Sentell |
| 4,229,136 | A | 10/1980 | Panissidi |
| 4,367,790 | A | 1/1983 | Draeger |
| 4,379,335 | A | 4/1983 | Kirsch et al. |

(Continued)

FOREIGN PATENT DOCUMENTS

| | | | |
|---|---|---|---|
| CN | 100500308 | C | 6/2009 |
| CN | 201828811 | U | 5/2011 |

(Continued)

OTHER PUBLICATIONS

Topcon introduces X-22 wireless excavator control system, www.equipmentworld.com/topcon-introduces-x-22-wireless-excavator-control-system/, Annotated, Equipment World Staff, Oct. 28, 2011, 4 pages.

(Continued)

*Primary Examiner* — Eric W Golightly

(74) *Attorney, Agent, or Firm* — Sand, Sebolt & Wernow Co., LPA

(57) ABSTRACT

A method and apparatus is provided for controlling a variable feed rate of a lance on a cleaning device for cleaning one or more tubes in a heat exchanger. Different regions of the tubes within the heat exchanger are identified as hotter regions and cooler regions depending on a temperature gradient of fluid moving through the heat exchanger. The hotter regions tend to develop more fouling on the inner surface of the tube. The lance uses the variable feed rate to spend more time cleaning the hotter regions with more fouling than the cooler regions with less fouling. This enables a more optimized cleaning profile to be implemented to efficiently clean the tubes in the heat exchanger.

20 Claims, 5 Drawing Sheets

(56) References Cited

U.S. PATENT DOCUMENTS 4,380,796 A 4/1983 Ostby
4,437,201 A 3/1984 Zalewski
4,527,515 A 7/1985 Hester, II
4,716,611 A 1/1988 Barry
4,760,859 A 8/1988 Brown
4,773,357 A 9/1988 Scharton et al.
4,813,146 A 3/1989 Jaluzot
4,918,817 A 4/1990 Eaton
5,092,193 A 3/1992 Yanagisawa
5,148,600 A 9/1992 Chen et al.
5,276,970 A 1/1994 Wilcox et al.
5,570,660 A 11/1996 Vandenberg
5,838,882 A 11/1998 Gan et al.
5,909,848 A 6/1999 Zink
5,947,387 A 9/1999 Zink et al.
5,954,494 A 9/1999 Goldsmith et al.
5,964,414 A 10/1999 Hardy et al.
6,059,202 A 5/2000 Zink et al.
6,085,994 A 7/2000 Zink
6,232,736 B1 5/2001 Bullen
6,457,792 B1 10/2002 Saund et al.
6,681,839 B1 1/2004 Balzer
6,779,746 B2 8/2004 Gromes
6,814,316 B2 11/2004 Gromes
6,877,930 B2 4/2005 Stromdahl et al.
7,228,125 B2 6/2007 Adachi et al.
7,635,096 B2 12/2009 Wright et al.
7,846,260 B2 12/2010 Jiang et al.
8,006,920 B2 8/2011 Wright et al.
8,016,210 B2 9/2011 Wright
8,057,607 B2 11/2011 Gardner et al.
8,078,297 B2 12/2011 Lasher et al.
8,195,344 B2 6/2012 Song et al.
8,220,724 B2 7/2012 Wright
8,308,869 B2 11/2012 Gardner et al.
8,434,696 B2 5/2013 Wright
8,505,845 B2 8/2013 Zink
8,524,011 B2 9/2013 Gardner et al.
8,544,768 B2 10/2013 Wright
8,573,599 B2 11/2013 Wright
8,612,641 B1 12/2013 Bozarth et al.
8,628,629 B2 1/2014 Gromes, Sr.
8,646,416 B2 2/2014 Hawkins et al.
8,667,987 B2 3/2014 Zink
8,668,155 B2 3/2014 Wright
8,676,390 B2 3/2014 Berry, Jr. et al.
8,720,811 B2 5/2014 Zink
8,863,775 B2 10/2014 Zink et al.
8,871,033 B2 10/2014 Zink
8,887,343 B2 11/2014 Zink
8,978,276 B2 3/2015 Moon, Jr. et al.
9,016,613 B2 4/2015 Zink
9,022,057 B2 5/2015 Zink
9,062,921 B2 6/2015 Gromes, Sr.
9,067,220 B2 6/2015 Wright
9,138,783 B2 9/2015 Gromes, Sr.
9,328,979 B2 5/2016 Brumfield
9,339,162 B2 5/2016 Gromes, Sr.
9,363,220 B2 6/2016 Ubillos et al.
9,372,037 B2 6/2016 Gromes, Sr.
9,395,001 B2 7/2016 Andersen
9,400,145 B2 7/2016 Mathis et al.
9,433,982 B2 9/2016 Zink
9,440,817 B2 9/2016 Zink
9,467,601 B2 10/2016 Zink et al.
9,550,649 B2 1/2017 Zink
9,605,915 B2 3/2017 Crock et al.
9,610,603 B2 4/2017 Wright
9,630,801 B2 4/2017 Barnes
9,662,689 B2 5/2017 Mathis et al.
9,699,361 B2 7/2017 Zink et al.
9,702,136 B2 7/2017 Andersen
9,844,845 B1 12/2017 Zink
9,845,594 B2 12/2017 Andersen
9,895,704 B2 2/2018 Gromes, Sr.
9,896,299 B2 2/2018 Barnes
9,919,333 B2 3/2018 Wright
9,939,215 B2 4/2018 Gzym et al.
9,950,348 B2 4/2018 Zink
9,964,368 B2 5/2018 Mathis et al.
9,981,822 B2 5/2018 Barnes
10,010,894 B2 7/2018 Andersen
10,024,613 B2 7/2018 Mathis
10,040,169 B2 8/2018 Gromes, Sr. et al.
10,118,185 B2 11/2018 Schneider
10,155,291 B2 12/2018 Zink
10,161,694 B2 12/2018 Maitrot et al.
10,265,736 B2 4/2019 Zink
10,265,834 B2 4/2019 Gromes, Sr. et al.
10,272,480 B2 4/2019 Zink et al.
10,336,571 B2 7/2019 Barnes
10,392,218 B2 8/2019 Barnes
10,399,129 B2 9/2019 Gromes, Sr. et al.
10,401,878 B2 9/2019 Gromes, Sr. et al.
10,408,552 B2 9/2019 Gromes, Sr. et al.
10,427,907 B2 10/2019 Barnes
10,480,874 B2 11/2019 Zink
10,502,509 B2 12/2019 Brumfield et al.
10,514,217 B2 12/2019 Wall et al.
10,599,162 B2 3/2020 Gromes, Sr. et al.
10,618,084 B2 4/2020 Gromes, Sr. et al.
10,684,082 B2 6/2020 Mathis
10,697,263 B2 6/2020 Gromes, Sr.
10,710,127 B2 7/2020 Barnes et al.
10,747,238 B2 8/2020 Gromes, Sr. et al.
10,774,606 B2 9/2020 Gromes, Sr.
10,781,652 B2 9/2020 Gromes, Sr.
10,809,023 B2 10/2020 Krauser et al.
10,890,390 B2 1/2021 Gromes, Sr. et al.
10,898,931 B2 1/2021 Zink
10,926,274 B2 2/2021 Schneider
10,933,453 B2 3/2021 Zink et al.
11,002,095 B2 5/2021 Gromes, Sr. et al.
11,040,380 B2 6/2021 Gromes, Sr. et al.
11,040,381 B2 6/2021 Gromes, Sr. et al.
11,052,437 B2 7/2021 Gromes, Sr. et al.
11,060,806 B2 7/2021 Montoya
11,148,151 B2 10/2021 Schneider et al.
11,168,529 B2 11/2021 Gromes, Sr.
11,198,141 B2 12/2021 Schneider et al.
11,248,860 B2 2/2022 Schneider et al.
11,286,738 B2 3/2022 Gromes, Sr.
11,294,399 B2 4/2022 Gromes, Sr. et al.
11,300,981 B2 4/2022 Gromes, Sr. et al.
11,326,844 B2 5/2022 Ferguson et al.
11,327,511 B2 5/2022 Gromes, Sr. et al.
11,360,494 B2 6/2022 Gromes, Sr. et al.
11,414,944 B2 8/2022 Gromes, Sr. et al.
11,441,856 B2 9/2022 Schneider et al.
11,460,257 B2 10/2022 Watkins et al.
11,517,947 B2 12/2022 Schneider et al.
11,674,761 B2 6/2023 Gromes, Sr. et al.
RE49,573 E 7/2023 Schneider
11,709,507 B2 7/2023 Gromes, Sr. et al.
11,713,932 B2 8/2023 Hastey et al.
11,733,720 B2 8/2023 Gromes, Sr. et al.
11,738,378 B2 8/2023 Schneider et al.
11,781,823 B2 10/2023 Gromes, Sr. et al.
11,781,852 B2 10/2023 Szabo
11,789,471 B2 10/2023 Gromes, Sr. et al.
11,841,197 B2 12/2023 Schneider et al.
11,874,077 B2 1/2024 Watkins et al.
11,934,215 B2 3/2024 Gromes, Sr. et al.
11,964,313 B2 4/2024 Gromes, Sr. et al.
2003/0065424 A1 4/2003 Erichsen et al.
2003/0147727 A1 8/2003 Fujishima et al.
2003/0202091 A1 10/2003 Garcia et al.
2004/0035445 A1 2/2004 Saxon et al.
2004/0035958 A1 2/2004 Gromes, Sr.
2004/0046069 A1 3/2004 Gromes, Sr.
2004/0069331 A1 4/2004 Garman et al.
2004/0093850 A1 5/2004 Horii et al.
2004/0182842 A1 9/2004 Denney et al.
2005/0196314 A1 9/2005 Petersen et al.

(56) References Cited

U.S. PATENT DOCUMENTS

2006/0090622 A1 5/2006 Adkins
2006/0212203 A1 9/2006 Furuno
2007/0257132 A1 11/2007 Wright et al.
2008/0062140 A1 3/2008 Hotelling et al.
2008/0175569 A1 7/2008 Johnson
2008/0185126 A1 8/2008 Jiang et al.
2008/0204426 A1 8/2008 Hotelling et al.
2008/0282583 A1 11/2008 Koellner et al.
2009/0097502 A1 4/2009 Yamamoto
2009/0206557 A1 8/2009 Wright
2010/0025492 A1 2/2010 Wright
2010/0065658 A1 3/2010 Wright et al.
2010/0095559 A1 4/2010 Buckner
2010/0185364 A1 7/2010 Mcclure
2010/0186971 A1 7/2010 Seyffert
2010/0313451 A1 12/2010 Trubiano
2011/0108636 A1 5/2011 Wright
2011/0186657 A1 8/2011 Haviland
2011/0220700 A1 9/2011 Zink
2011/0287692 A1 11/2011 Erichsen et al.
2011/0297761 A1 12/2011 Wright
2011/0301755 A1 12/2011 Anderson
2011/0315164 A1 12/2011 Desormeaux
2012/0007885 A1 1/2012 Huston
2012/0024321 A1 2/2012 Hays
2012/0025002 A1 2/2012 Zink
2012/0061108 A1 3/2012 Cerrano
2012/0067370 A1 3/2012 Crock et al.
2012/0103368 A1 5/2012 Gromes, Sr.
2012/0204368 A1 8/2012 Zink
2012/0205405 A1 8/2012 Zink et al.
2012/0227815 A1 9/2012 Zink
2012/0229662 A1 9/2012 Lankalapalli et al.
2012/0247570 A1 10/2012 Zink
2012/0255588 A1 10/2012 Wright
2012/0330449 A1 12/2012 Edwards et al.
2013/0030589 A1 1/2013 Pessina et al.
2013/0033090 A1 2/2013 Jokonya
2013/0042894 A1 2/2013 Gromes, Sr.
2013/0118529 A1 5/2013 Gromes, Sr.
2013/0167697 A1 7/2013 Reukers
2013/0200177 A1 8/2013 Wright
2013/0271004 A1 10/2013 Min et al.
2013/0299621 A1 11/2013 Zink
2014/0008459 A1 1/2014 Wright
2014/0045409 A1 2/2014 Zhang et al.
2014/0046477 A1 2/2014 Brahan et al.
2014/0109936 A1 4/2014 Gromes, Sr.
2014/0150894 A1 6/2014 Zink
2014/0151488 A1 6/2014 Zink
2014/0285656 A1 9/2014 Zink et al.
2014/0333525 A1 11/2014 Gromes, Sr. et al.
2014/0336793 A1 11/2014 Gromes, Sr. et al.
2014/0336827 A1 11/2014 Gromes, Sr. et al.
2014/0336828 A1 11/2014 Gromes, Sr. et al.
2014/0352464 A1 12/2014 Zink
2015/0000760 A1 1/2015 Zink
2015/0034128 A1 2/2015 Brumfield
2015/0065114 A1 3/2015 Dua
2015/0068563 A1 3/2015 Gzym et al.
2015/0083536 A1 3/2015 Andersen
2015/0202666 A1 7/2015 Zink
2015/0204768 A1 7/2015 Newman
2015/0246789 A1 9/2015 Gromes, Sr. et al.
2015/0258694 A1 9/2015 Hand et al.
2015/0266036 A1 9/2015 Andersen
2015/0366426 A1 12/2015 Gromes, Sr.
2015/0379785 A1 12/2015 Brown, Jr. et al.
2016/0008826 A1 1/2016 Schneider
2016/0023264 A1 1/2016 Barnes
2016/0025432 A1 1/2016 Mathis et al.
2016/0025433 A1 1/2016 Mathis
2016/0091096 A1 3/2016 Andersen
2016/0096202 A1 4/2016 Zink
2016/0129552 A1 5/2016 Gromes, Sr. et al.
2016/0158809 A1 6/2016 Zink
2016/0199870 A1 7/2016 Wright
2016/0243564 A1 8/2016 Andersen et al.
2016/0243597 A1 8/2016 Shawver
2016/0244959 A1 8/2016 Andersen
2016/0303618 A1 10/2016 Mathis et al.
2016/0381258 A1 12/2016 Zink et al.
2017/0021395 A1 1/2017 Gromes, Sr.
2017/0102195 A1 4/2017 Watkins
2017/0107076 A1 4/2017 Barnes
2017/0108300 A1 4/2017 Brumfield
2017/0157636 A1 6/2017 Wright
2017/0183193 A1 6/2017 Barnes
2017/0219304 A1 8/2017 Mathis et al.
2017/0250639 A1 8/2017 Lachappelle et al.
2017/0274429 A1 9/2017 Barnes et al.
2017/0321976 A1 11/2017 Barnes
2017/0348931 A1 12/2017 Yuzer et al.
2017/0356702 A1 12/2017 Gromes, Sr. et al.
2017/0364096 A1 12/2017 Gromes, Sr. et al.
2018/0058783 A1 3/2018 Zink
2018/0099364 A1 4/2018 Zink
2018/0134511 A1 5/2018 Barnes
2018/0161833 A1 6/2018 Zink et al.
2018/0207686 A1 7/2018 Zink
2018/0266777 A1 9/2018 Krauser et al.
2018/0281030 A1 10/2018 Eisermann et al.
2018/0283818 A1 10/2018 Horn et al.
2018/0292151 A1 10/2018 Mathis
2018/0372432 A1 12/2018 Watkins
2019/0032828 A1 1/2019 Zink et al.
2019/0041877 A1 2/2019 Gromes, Sr. et al.
2019/0063856 A1 2/2019 Montoya
2019/0145208 A1 5/2019 Gromes, Sr.
2019/0145209 A1 5/2019 Gromes, Sr.
2019/0145210 A1 5/2019 Gromes, Sr.
2019/0163207 A1 5/2019 Gromes, Sr. et al.
2019/0210077 A1 7/2019 Zink et al.
2019/0211641 A1 7/2019 Gromes, Sr.
2019/0218058 A1 7/2019 Barnes
2019/0224724 A1 7/2019 Gromes, Sr. et al.
2019/0224725 A1 7/2019 Gromes, Sr. et al.
2019/0337028 A1 11/2019 Gromes, Sr. et al.
2019/0346866 A1 11/2019 Gromes, Sr. et al.
2019/0353437 A1 11/2019 Gromes, Sr. et al.
2020/0056851 A1 2/2020 Watkins et al.
2020/0114371 A1 4/2020 Schneider et al.
2020/0114373 A1 4/2020 Schneider
2020/0132402 A1 4/2020 Schneider et al.
2020/0166957 A1 5/2020 Gromes, Sr. et al.
2020/0166958 A1 5/2020 Gromes, Sr. et al.
2020/0197985 A1 6/2020 Gromes, Sr. et al.
2020/0206790 A1 7/2020 Gromes, Sr. et al.
2020/0208484 A1 7/2020 Gromes, Sr.
2020/0232729 A1 7/2020 Schneider et al.
2020/0256147 A1 8/2020 Gromes, Sr.
2020/0261925 A1 8/2020 Schneider et al.
2020/0263941 A1 8/2020 Schneider et al.
2020/0333093 A1* 10/2020 Ferguson ..... F28G 15/04
2020/0356117 A1 11/2020 Gromes, Sr. et al.
2020/0356118 A1 11/2020 Gromes, Sr. et al.
2020/0391257 A1 12/2020 Schneider et al.
2021/0026379 A1 1/2021 Gromes, Sr. et al.
2021/0207903 A1 7/2021 Gromes, Sr. et al.
2021/0230956 A1 7/2021 Gromes, Sr. et al.
2021/0283664 A1 9/2021 Gromes, Sr. et al.
2022/0057151 A1 2/2022 Hastey et al.
2022/0062923 A1 3/2022 Schneider et al.
2022/0062925 A1 3/2022 Wright et al.
2022/0163311 A1 5/2022 Szabo
2022/0187854 A1 6/2022 Gromes, Sr. et al.
2022/0187855 A1 6/2022 Gromes, Sr. et al.
2022/0228821 A1 7/2022 Gromes, Sr. et al.
2022/0261014 A1 8/2022 Gromes, Sr. et al.
2022/0290932 A1 9/2022 Barnes et al.
2023/0028473 A1 1/2023 Watkins et al.
2023/0102746 A1 3/2023 Schneider et al.
2023/0278047 A1 9/2023 Lange
2023/0321695 A1 10/2023 Zink

(56) References Cited

U.S. PATENT DOCUMENTS

| | | | |
|---|---|---|---|
| 2023/0405646 | A1 | 12/2023 | Schneider et al. |
| 2024/0027149 | A1 | 1/2024 | Hastey et al. |
| 2024/0102753 | A1 | 3/2024 | Schneider et al. |
| 2024/0118069 | A1 | 4/2024 | Szabo |

FOREIGN PATENT DOCUMENTS

| | | | |
|---|---|---|---|
| CN | 203250208 | U | 10/2013 |
| CN | 203837569 | U | 9/2014 |
| CN | 104181867 | A | 12/2014 |
| CN | 104440896 | | 3/2015 |
| DE | 3426889 | | 5/1985 |
| DE | 102014104356 | | 10/2015 |
| EP | 0569080 | | 11/1993 |
| EP | 0803697 | | 10/1997 |
| EP | 1669711 | | 6/2006 |
| FR | 2563331 | | 10/1985 |
| WO | 20010111303 | | 2/2001 |
| WO | 2009131512 | | 10/2009 |
| WO | 2016037197 | | 3/2016 |
| WO | 2020086873 | | 4/2020 |

OTHER PUBLICATIONS

WardJet Brochure, X-Classic Controller, 2012, 3 pages.

Operation Manual Sabertooth Air Powered Dual Hose Reel StoneAge, StoneAge Waterblast Tools, (Sep. 1, 2010), pp. 1-7, XP055762268.

Spong, et al. Robot Dynamics and Control. 2nd Edition p. 9,1.1, pp. 13-22, 1.3.1-1.3.6; Jan. 28, 2004, 303 pages.

Shawver. How Automated Water Jetting Improves Tube Bundle Cleaning Efficiency. 2011 WJTA-IMCA Conference and Expo. Sep. 2011. Houston, TX, 5 pages.

Video Stutes Enterprise Live Demo—2013 WJTA-IMCA Conference & Expo (https://www.youtube.com/watch?v=zoCFoopM yU), 5 pages.

Video Peinemann Equipment Live Demo—2013 WJTA-IMCA Conference & Expo Sep. 11, 2013 (https://www.youtube.com/watch ?v=GPa2w65ZNkE), 4 pages.

Video Veolia Diamondback(https://www.youtube.com/watch?v= 8tAZwctqneQ); Feb. 13, 2014, 7 pages.

International Search Report, PCT/US/2006/015762, May 1, 2026, 3 pages.

* cited by examiner

METHOD OF CONTROLLING LANCE MOVEMENT THROUGH HEATER EXCHANGER ASSEMBLIES

TECHNICAL FIELD

This disclosure is directed to methods and apparatuses for cleaning heat exchanger bundles utilizing high pressure water.

BACKGROUND ART

Heat exchangers typically include a tube bundle, i.e., a plurality of individual tubes, encased in an outer shell that is typically cylindrical in configuration. An end of each tube terminates in a face plate that is secured to one end of the cylindrical shell by a flange. The face plate defines a plurality of openings therein and each of these openings permits access to the bore of one of the tubes in the tube bundle.

After a heat exchanger has been used for some time the bores of the heat exchanger tubes tend to become partially or completely blocked with material that has been deposited therein. It is necessary to clean out this accumulated material from time to time. The typical way of cleaning these tubes is by directing a high pressure water-jet into the bore and blasting away the built-up material.

The tubes in a heat exchanger can experience a build up of material at different portions of the tube depending on the temperature differential or temperature gradient experienced at different regions of the tube. This can make the tube difficult to clean due to the deposition of material not being uniform.

SUMMARY OF THE INVENTION

To address the non-uniformity of built-up material (i.e., fouling) in the tubes, the present disclosure presents various techniques for cleaning tubes in a heat exchanger in a way that accounts for the non-uniform fouling inside of tubes.

In one aspect, an exemplary embodiment of the present disclosure provides a computer program product including at least one non-transitory machine-readable medium encoded with instructions that when executed by one or more processors cause a process for cleaning device to feed a lance into a tube in a heat exchanger at a variable feed rate dependent on temperatures of different portions of the tube, the instructions comprising: receive identified hotter regions and cooler regions within an internal volume of the heat exchanger, wherein there is more fouling on an inner surface of the tube in the hotter regions and less fouling on the inner surface of the tube in the cooler regions; generate the variable feed rate of the lance based on the hotter regions and the cooler regions, wherein the variable feed rate is slower in the hotter regions and faster in the cooler regions; feed the lance into the tube at the variable feed rate; and dispense a cleaning fluid from a nozzle on the lance toward an inner surface of the tube as the lance is fed at the variable feed rate, wherein the cleaning fluid contacts the inner surface of the tube to clean the fouling therefrom. This exemplary embodiment or another exemplary embodiment may further provide that the instructions further comprise: reduce a period of time during which the cleaning fluid is dispensed in the cooler regions relative to a period of time during which the cleaning fluid is dispensed in the hotter regions. This exemplary embodiment or another exemplary embodiment may further provide that the instructions further comprise: increase a period of time during which the cleaning fluid is dispensed in the hotter regions relative to a period of time during which the cleaning fluid is dispensed in the cooler regions. This exemplary embodiment or another exemplary embodiment may further provide that the instructions further comprise: continuously monitor cleaning and temperature data; and adjust, in real-time, the feed rate as cleaning progresses. This exemplary embodiment or another exemplary embodiment may further provide that map locations of the hotter regions and cooler regions within the tubes.

In yet another aspect, another exemplary embodiment of the present disclosure may provide a method comprising: receiving identified hotter regions and cooler regions within an internal volume of a heat exchanger, wherein there is more fouling on an inner surface of a tube within the heat exchanger in the hotter regions and less fouling on the inner surface of the tube in the cooler regions; generating a variable feed rate of a lance on a cleaning device, wherein the variable feed rate is based on the hotter regions and the cooler regions, and wherein the variable feed rate is slower in the hotter regions and faster in the cooler regions; feeding the lance into the tube at the variable feed rate; and dispensing a cleaning fluid from a nozzle on the lance toward an inner surface of the tube as the lance is fed at the variable feed rate, wherein the cleaning fluid contacts the inner surface of the tube to clean the fouling therefrom. This exemplary embodiment or another exemplary embodiment may further include reducing a period of time during which the cleaning fluid is dispensed in the cooler regions relative to a period of time during which the cleaning fluid is dispensed in the hotter regions. This exemplary embodiment or another exemplary embodiment may further include increasing a period of time during which the cleaning fluid is dispensed in the hotter regions relative to a period of time during which the cleaning fluid is dispensed in the cooler regions. This exemplary embodiment or another exemplary embodiment may further include continuously monitoring cleaning and temperature data; and adjusting, in real-time, the feed rate as cleaning progresses. This exemplary embodiment or another exemplary embodiment may further include mapping locations of the hotter regions and cooler regions within the tubes.

In yet another aspect, the present disclosure provides a method and apparatus for controlling a variable feed rate of a lance on a cleaning device for cleaning one or more tubes in a heat exchanger. Different regions of the tubes within the heat exchanger are identified as hotter regions and cooler regions depending on a temperature gradient of fluid moving through the heat exchanger. The hotter regions tend to develop more fouling on the inner surface of the tube. The lance uses the variable feed rate to spend more time cleaning the hotter regions with more fouling than the cooler regions with less fouling. This enables a more optimized cleaning profile to be implemented to efficiently clean the tubes in the heat exchanger.

BRIEF DESCRIPTION OF THE DRAWINGS

One or more exemplary embodiment(s) of the present disclosure is set forth in the following description, is shown in the drawings and is particularly and distinctly pointed out and set forth in the appended claims. The accompanying drawings, which are incorporated in and constitute a part of the specification, illustrate various example configurations and methods, and other example embodiments of various aspects of the invention. It will be appreciated that the illustrated element boundaries (e.g., boxes, groups of boxes, or other shapes) in the figures represent one example of the boundaries. One of ordinary skill in the art will appreciate that in some examples one element may be designed as multiple elements or that multiple elements may be designed as one element. In some examples, an element shown as an internal component of another element may be implemented as an external component and vice versa. Furthermore, elements may not be drawn to scale.

Similar numbers refer to similar parts throughout the drawings.

DETAILED DESCRIPTION

Figure 1:
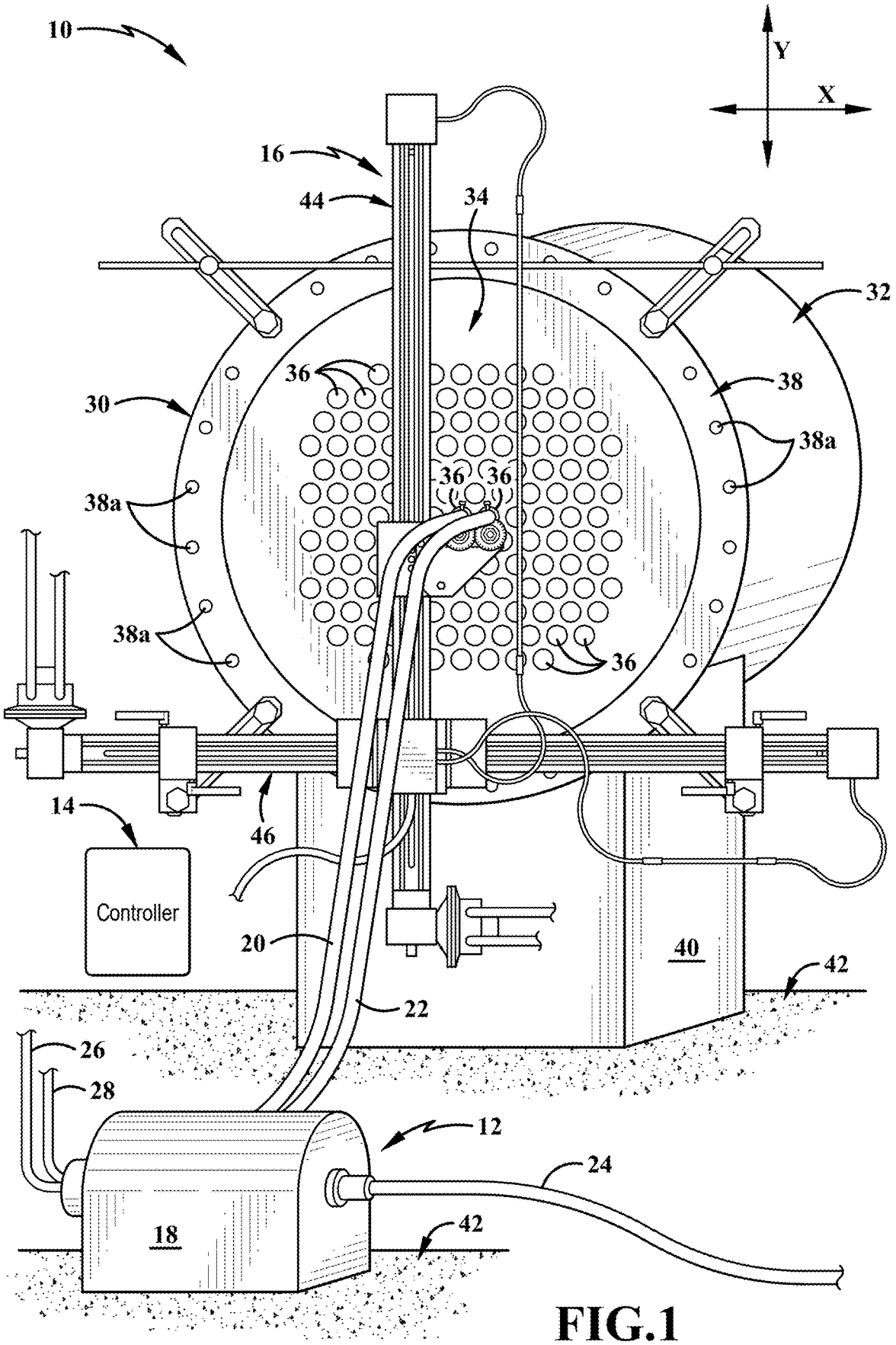
FIG. 1 is a perspective view of an exemplary water jet cleaning system according to one embodiment of the present disclosure.

FIG. 1 shows, in the upper right hand corner thereof, a symbol to represent cartesian directions utilized in the description that follows. The symbol shows an X-axis to represent a horizontal axis or direction and a Y-axis to represent a vertical axis or direction The X-axis and Y-axis are oriented at right angles to each other. Furthermore, a Z-axis represents a longitudinal axis or direction corresponding to a depth or length of components detailed herein such that the Z-axis is orthogonal to the X-axis and the Y-axis.

Figure 1A:
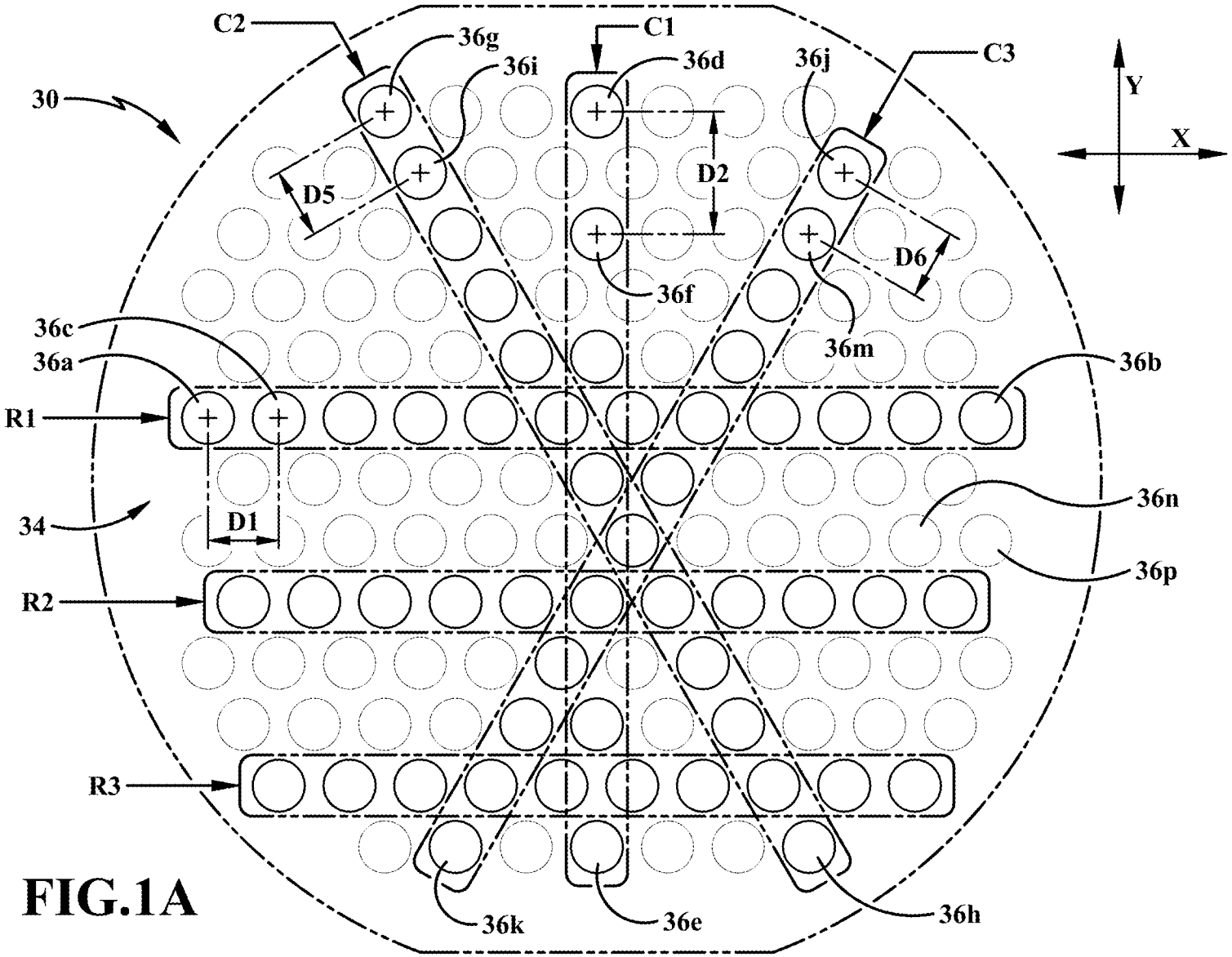
FIG. 1A is an elevation view of an exemplary tube bundle.
Figure 1B:
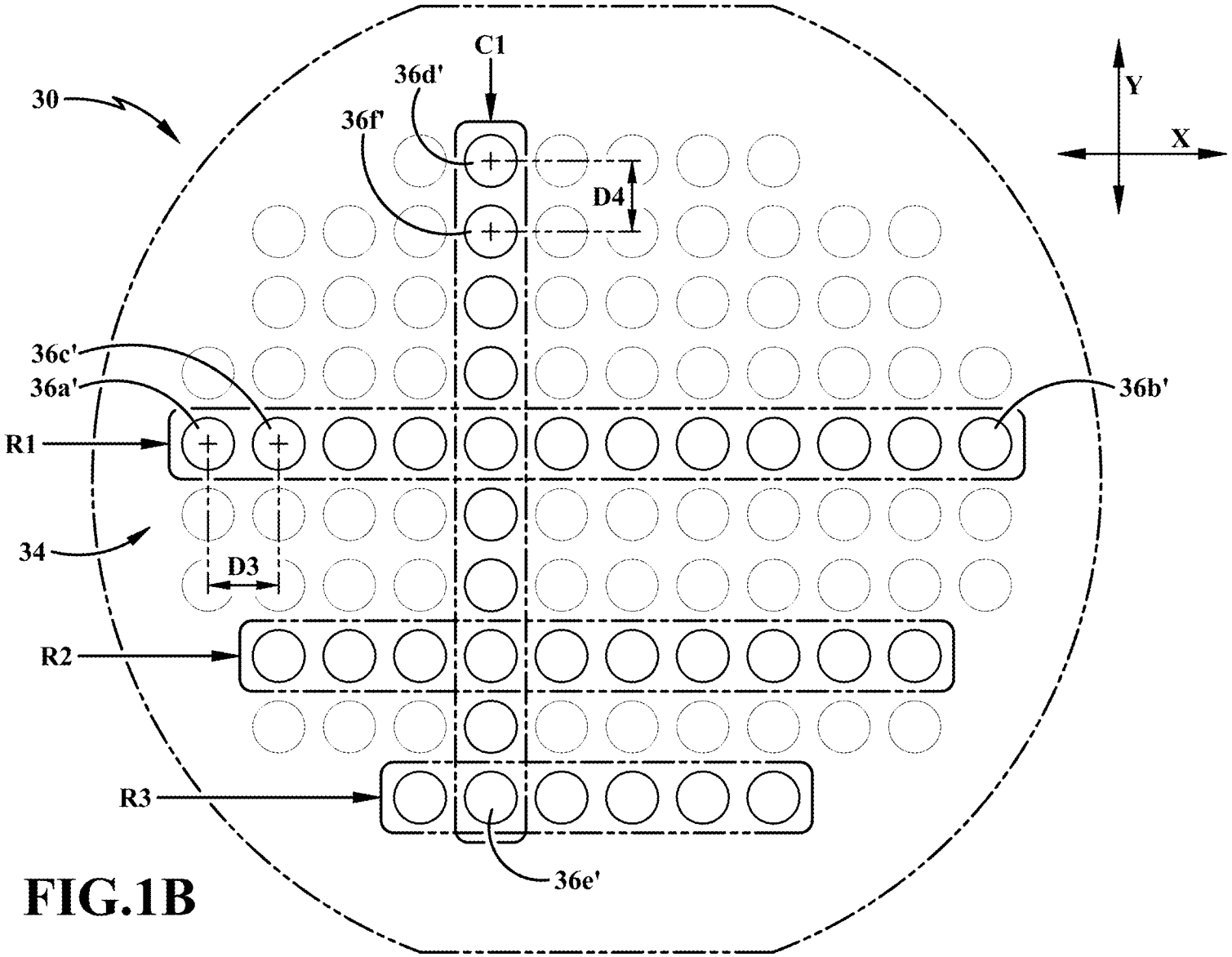
FIG. 1B is an elevation view of another exemplary tube bundle.

Referring to FIG. 1, FIG. 1A, and FIG. 1B, there is shown a water-jet cleaning system in accordance with an aspect of the present disclosure, generally indicated at 10. System 10 may include a water delivery system 12 for providing water for a cleaning operation, a communication device or controller 14, and an indexer or positioner 16 (e.g., a positioning device that indexes) in accordance with the aspect of the present disclosure. Additionally, the system 10 may operate in one or more of the methods or processes detailed herein. The communication device or controller 14 may be used to control and operate positioner 16 and water delivery system 12. While system 10 is described herein as being useful for cleaning heat exchanger tubes, it will be understood by those skilled in the art that system 10 may be used for a wide variety of other purposes. An operator using communication device or controller 14 may control the various components of the water-jet cleaning system 10.

It should be understood that while the system 10 is named a "cleaning system" in this description, the system 10 may be used for any of a variety of purposes other than "cleaning". Furthermore, while the material moving through and being delivered to a surface by system 10 is named herein as "water", it should be understood that any fluid or liquid other than actual water may flow through system 10. The term "water" should therefore be understood to encompass any fluid or liquid moving through system 10 and should further be understood to include fluids or liquids that may include solids therein. For example, a gas including abrasive particles may flow through and be delivered to a surface by system 10. Such a gas-entrained abrasive should be understood to be encompassed by the term "water".

It should be noted that while water delivery system 12 is illustrated as a hose reel assembly in the attached figures, any other system, device, or method for delivering water or other liquids to be used in a cleaning operation may comprise part of water-jet cleaning system 10. Water delivery system 12 preferably delivers water or cleaning fluid under high pressure to positioner 16. The hose reel assemblies disclosed in U.S. Pat. No. 9,062,921 (Gromes) and in U.S. patent application Ser. No. 14/713,664 filed May 15, 2015 (Gromes) and entitled "Hose Reel Assembly", are examples of a suitable water delivery system 12 that may be utilized in system 10. The illustrated hose reel assembly includes a cover 18 that surrounds and protects a hose reel, one or more motors, pumps, and valves. A first hose 20 and a second hose 22 may connect the hose reel assembly to positioner 16. A third hose 24 may connect the hose reel assembly to a remote water or liquid source (not shown). First and second hydraulic input/output lines 26, 28 extend outwardly from water delivery system 12 and may be operatively engaged with a remote hydraulic fluid source (not shown). The hoses 20, 22 deliver water or other liquids to be used in a cleaning operation to lances that are carried by the positioner 16. The lances are tubes that are moved into and out of tubes 36 in a tube bundle in the heat exchanger 30 and eject water from the lances to clean the tubes.

Although not illustrated herein, system 10 may include a hub similar to that described in the Applicant's U.S. patent application Ser. No. 16/464,279, entitled "Indexer, Indexer Retrofit Kit and Method of Use Thereof". The hub may include a plurality of receptacles that are utilized to connect sensor cables, air sources, lubricants etc. to other components of system 10.

The valves in the hose reel assembly may include shut-off valves that may be actively controlled by the operator using communication device 14 or the shut-off valves may be activated if the operator breaks contact with communication device 14. Communication device 14 may also be referred to as a controller 14 inasmuch as it controls the operation of the positioner and/or other components of system 10.

Communication device or controller 14 may be any one of a variety of programmable electronic devices. These may include, but are not limited to, a smart-phone, a tablet, a lap-top computer, a handheld device with joysticks or D-pad controls, and a control table. Communication device or controller 14 may be provided with special programming that enables Communication device or controller 14 to be used to control and operate water delivery system control box 12 and positioner 16. A particularly suitable communication device or controller 14 and a program for this purpose may be a tablet that is provided with programming. A wireless communication device or controller and a method for controlling water cleaning equipment utilizing the communication device or controller and the programming is disclosed in several patent applications all commonly owned by the Applicant. These patent applications include U.S. patent application Ser. No. 14/204,264 filed Mar. 11, 2014 entitled "Adaptive Controller", now U.S. Pat. No. 10,864,834; U.S. patent application Ser. No. 14/204,344 14/204,350 filed Mar. 11, 2014, entitled "System and Method for Wireless Control using a Deadman Switch", now U.S. Pat. No. 10,040,169; U.S. patent application Ser. No. 14/204,451, filed Mar. 11, 2014, entitled "Mechanism for Remotely Controlling Water-jet Equipment"; U.S. patent application Ser. No. 14/204,555 filed Mar. 11, 2014 entitled "Method and Apparatus for using an Application to Control with a Deadman's Switch; and U.S. patent application Ser. No. 14/997,035 filed Jan. 15, 2015 entitled "Mechanism for Remotely Controlling Equipment"; U.S. Publication NO. 2024/0118069A1, filed Apr. 11, 2024 entitled "FLUID LANCE STOP POSITION SENSOR DETECTION METHOD AND SYSTEM"; U.S. Publication No. US2023/0405646A1, filed Dec. 21, 2023 entitled "AUTO-INDEXING LANCE POSITIONER APPARATUS AND SYSTEM"; U.S. Pat. No. 11,738,378, filed Aug. 29, 2023 entitled "Auto-indexing lance positioner apparatus and system"; U.S. Publication No. 2023/0102746A1, filed Mar. 30 2023, entitled "AUTO-INDEXING LANCE POSITIONER APPARATUS AND SYSTEM"; U.S. Pat. No. 11,874,077, filed Jan. 16, 2024 entitled "Flexible lance drive apparatus with autostroke function"; U.S. Publication No. 2023/0028473, filed Jan. 26, 2023 entitled "Flexible Lance Drive Apparatus with Autostroke Function"; U.S. Publication No. 2023/0021966A1, filed Jan. 26, 2023 entitled "Dual Endless Belt Flexible Lance Hose Drive Apparatus and System"; U.S. Pat. No. 11,789,471, filed Oct. 17, 2023, entitled "Method of cleaning heat exchangers or tube bundles using a cleaning station"; U.S. Publication No. 2022/0261014A1, filed Aug. 18, 2022 entitled "METHOD OF CLEANING HEAT EXCHANGERS OR TUBE BUNDLES USING A CLEANING STATION"; U.S. Pat. No. 11,733,720, filed Aug. 22, 2023 entitled "Indexer and method of use thereof"; U.S. Publication No. 2022/0187854, filed Jun. 16, 2022, entitled "INDEXER AND METHOD OF USE THEREOF"; U.S. Pat. No. 11,781,852, filed Oct. 10, 2023 entitled "Fluid lance stop position sensor detection method and system"; U.S. Publication No. 2022/0163311, filed May 26, 2022 entitled "FLUID LANCE STOP POSITION SENSOR DETECTION METHOD AND SYSTEM"; U.S. Pat. No. 11,517,947B2, filed Dec. 6, 2022 entitled "Auto-indexing lance positioner apparatus and system"; U.S. Publication No. 2020/0391257, filed Dec. 17, 2020 entitled "AUTO-INDEXING LANCE POSITIONER APPARATUS AND SYSTEM"; U.S. Pat. No. 11,709,507 filed Jul. 25, 2023 entitled "Method of performing a cleaning operation using a water jet device"; U.S. Pat. No. 11,441,856, filed Sep. 13, 2022 entitled "Auto-indexing lance positioner apparatus and system"; U.S. Pat. No. 11,460,257 filed Oct. 4, 2022 entitled "Flexible lance drive apparatus with autostroke function"; U.S. Publication No. 2020/005685 filed Feb. 20, 2020 entitled "FLEXIBLE LANCE DRIVE APPARATUS WITH AUTOSTROKE FUNCTION"; U.S. Publication No. 2020/0132402, filed Apr. 30, 2020 entitled "AUTO-INDEXING LANCE POSITIONER APPARATUS AND SYSTEM". The entire disclosures of all of these applications and patents are incorporated herein by reference, and support other aspects of the present disclosure beyond the communication device or controller 14, such as exemplary indexers, exemplary positioners, exemplary lances, or exemplary tractors, exemplary pneumatic devices, amongst other components. Namely, many components of legacy tube cleaning devices, such as the lances, valves, powerhubs, solenoids, motors, and the like are similar to that which the Applicant currently provides and are not repeated for brevity since they are incorporated by reference, yet embodiments of the present disclosure may focus on improved operations thereof.

Communication device or controller 14 may control water delivery system 12 and positioner 16 wirelessly as wireless communication will permit the operator of system 10 to be located a distance away from positioner 16 and therefore a distance away from the water-jet cleaning operation performed thereby. Wireless operation from a remote distance increases safety for the operator as the high pressure water-jets delivered by positioner 16 could seriously injure the operator if he or she comes into contact therewith.

Communication device or controller 14 may be Bluetooth® enabled and may be paired to multiple devices via a master/slave relationship. For example, the Communication device or controller 14 may execute instructions to pump in water delivery system 12 and/or to other components on positioner 16. A user interface on Communication device or controller 14 may include a "Connect button" that allows device 14 to scan for other devices or components of system 10 with which to pair Communication device or controller 14. A listing or menu of Bluetooth® enabled devices may appear on the user interface and the operator may then select which devices or components to link with communication device or controller 14. Appropriate security codes may be required to enable the pairing and, once connected, the Bluetooth® connectivity may not be severed from an outside source. If Bluetooth® connection is lost then all operations controlling positioner 16, water delivery system 12 etc. will cease automatically and substantially immediately, i.e., with only the delay required to break communication and shut-off operations (around a few seconds).

FIG. 1, FIG. 1A, and FIG. 1B illustrate an exemplary heat exchanger 30 that may be cleaned using system 10. Heat exchanger 30 may comprise a tube bundle encased in a hollow cylindrical shell 32. A tube bundle may be comprised of a plurality of individual cylindrical tubes that are arranged side-by-side and one above the other. Each tube 36 in the tube bundle terminates in a face plate 34 that is provided at one end of shell 32. A plurality of openings to the tubes 36 is defined in face plate 34 and each opening provides access to a bore of one of the tubes 36 in the tube bundle. Because the tubes in the tube bundle of heat exchanger 30 may be arranged in a particular manner relative to each other, the openings to the tubes 36 in face plate 34 tend to be arranged in a pattern. A first exemplary pattern of openings or tubes 36 is shown in FIG. 1A and a second exemplary pattern of openings or tubes 36 is shown in FIG. 1B. The pattern shown in FIG. 1A may be termed a "honeycomb" pattern while the pattern shown in FIG. 1B may be termed a "straight line" pattern. It will be understood that other different patterns of openings or tubes 36 may be presented on face plate 34 since these patterns are the result of the specific arrangement and configuration of the tubes in the tube bundle of a specific heat exchanger. Typically, however, face plate 34 will tend to show a honeycomb or straight line pattern but the spacing and angle between the various openings may change from heat exchanger to heat exchanger.

Face plate 34 may be secured to one end of shell 32 by a flange 38. Flange 38 may define a plurality of apertures 38*a* therein that are located at intervals around a circumference of flange 38. Positioner 16 may be selectively engaged with flange 38 or any other part of heat exchanger 30 in any suitable manner. Heat exchanger 30 is shown in FIG. 1 supported on a base 40 that rests upon a surface 42. It will be understood, however, that the base and surface are for the purposes of illustration only.

Positioner 16 may include a first arm or rail 44 and a second arm or rail 46 that may be oriented at right angles to each other. Collectively, when the first arm or rail 44 and the second arm or rail 46 are assembled together, they are referred to as the rail assembly on positioner 16. As shown in FIG. 1, positioner 16 may be engaged with flange 38 in such a way that first arm or rail 44 is substantially parallel to the Y-axis and second arm or rail 46 is substantially parallel to the X-axis. It will be understood, however, that positioner 16 may be engaged in a different manner with flange 38 so that first arm or rail 44 may be oriented at an angle relative to the Y-axis and/or second arm or rail 46 may be oriented at an angle to X-axis. The orientation and positioning of first arm or rail 44 and second arm or rail 46 of positioner 16 may be selected to accommodate any pattern of openings 36 in a face plate 34 of any heat exchanger 30. The first arm or rail 44 is coupled to the tube bundle and the second arm or rail 46 is coupled to the tube bundle. In one embodiment, at least one of the first rail and the second rail establishes an angle greater than 0 and less than 90 degrees relative to horizontal when that rail is coupled to the tube bundle. As stated previously, the cleaning device that is moveable relative to the first rail and the second rail. The assembly of the present disclosure may include a compensation mechanism to adjust movement of the cleaning device based on the angle, wherein the compensation mechanism is adapted to reduce installation time of the first rail and the second rail by eliminating the need for the rails to be at either 0 degrees or 90 degrees relative to horizontal when coupled to the tube bundle. In one embodiment, the compensation mechanism may be a motion controller. The motion controller is configured to improve accuracy of the lances being inserted into the tubes.

FIG. 1A shows, by way of example only, a pattern of openings or tubes 36 on face plate 34. Openings or tubes 36 are shown arranged in rows and columns, such as rows R1, R2, R3, and columns C1, C2 and C3. Rows R1, R2, and R3 may be oriented generally parallel to the X-axis. Row R1 is identified in this figure by a first highlighted region and is shown as including twelve openings. A first opening 36*a* may be provided at first end of the row R1 and a second opening 36*b* may be provided at an opposite second end of the row R1. For the operation of system 10, the second opening 36*b* does not have to be on the opposite second end of row R1 but may simply be spaced some distance laterally away from first opening 36*a*. Preferably, for the method described herein, second opening 36*b* should not be adjacent first opening 36*a* but spaced a distance away therefrom. In other words, first opening 36*a* and second opening 36*b* preferably are non-contiguous. Another opening 36*c* may be located adjacent first opening 36*a* and openings 36*a* and 36*c* may be spaced a distance "D1" apart from each other. The openings along row R1 may be provided at substantially equal intervals from each other, namely, a distance "D1" away from each other.

While the openings in row R1 ideally may be generally parallel to the X-axis, the row of openings may, in reality, be oriented at a slight angle or slope relative to the X-axis. For example, if an imaginary line is drawn from a center of first opening 36*a* (marked by the + sign) to a center of second opening 36*b*, that line might be sloped (i.e., oriented at a slight angle) relative to the X-axis instead of being parallel to the X-axis.

FIG. 1A also shows, by way of example only, a plurality of columns of openings such as columns C1, C2, C3. Columns C1, C2 are identified by the second, third and fourth highlighted regions on FIG. 1A. Column C1 is shown as being generally parallel to the Y-axis; column C2 is shown oriented at a first angle relative to the Y-axis and column C3 is shown oriented at a second angle relative to the Y-axis. Column C1, as illustrated, includes seven openings that are spaced at generally equal intervals from each other. A first opening 36*d* may be provided at a first end of column C1 and a second opening 36*e* may be provided at an opposite second end of column C1. (The second opening 36*e* does not have to be on the opposite second end of column C1 but should preferably be spaced remote from first opening 36*d*, i.e., some distance away therefrom. (Preferably, second opening 36*e* should not be adjacent first opening 36*d*.) Another opening 36*f* may be located adjacent to the first opening 36*e* and openings 36*d*, 36*f* may be spaced a distance "D2" apart from each other. Openings along column C1 may therefore be spaced at equal intervals from each other, with the interval between adjacent openings being a distance "D2". As with the row R1, if one draws an imaginary line from a center of the first opening 36*d* to a center of the second opening 36*e*, there may be an offset between the centers and therefore a slight slope or angle of the line of openings along that imaginary line relative to the Y-axis axis.

Column C2, as illustrated in FIG. 1B, has thirteen openings and includes a first opening 36*g* at one end and a second opening 36*h* at an opposite end of the column. Another opening 36*i* is shown adjacent first opening 36*g* and openings 36*g*, 36*i* are spaced a distance "D5" apart from each other. The openings along the "axis" of column C2 are therefore spaced at generally equal intervals ("D5") from each other and the centers of the openings in this column C2 may be offset from each other and therefore the column C2 may be oriented at a slight slope or angle relative to an axis along which column C2 might extend.

Column C3, as illustrated in in FIG. 1A, has twelve openings that are spaced at substantially equal intervals from each other. Column C3 as shown includes a first opening 36*j* at a first end of the column, a second opening 36*k* at a second end of the column and another opening 36*m* adjacent first opening 36*j*. Openings 36*j* and 36*m* are spaced a distance "D6" apart from each other. Adjacent openings along the "axis" of column C3 may be spaced a distance "D6" away from each other and the line of openings may be oriented at an angle or slope relative to that axis.

FIG. 1B shows a different exemplary pattern of openings in face plate 34. The pattern shown in FIG. 1B may be a grid pattern where the rows, such as row R1, R2 and R3 are all oriented generally parallel to the X-axis; and the columns, such as columns C1, C2, C3 are all oriented generally parallel to the Y-axis. Row R1, as illustrated in FIG. 1B, has twelve openings therein including a first opening 36*a*' at a first end and a second opening 36*b*' at a second end. Another opening 36*c*' is located adjacent first opening 36*a*' and is spaced a distance "D3" therefrom. Column C1, as illustrated in FIG. 1B, has ten openings therein including a first opening 36*d*' at one end of the column and a second opening 36*e*' at an opposite end thereof. Another opening 36*f*' is located adjacent first opening 36*d*' and is spaced a distance "D4" therefrom.

No matter the specific pattern of openings or tubes 36 on face plate 34, positioner 16 may be used to correctly position a nozzle on a lance of the water delivery system 12 in a location relative to each of those openings or tubes 36 that is suitable to direct water or cleaning fluid into the bore of the associated tube in the tube bundle. This will be further described herein.

Various indexers or positioners that could embody positioner 16 are disclosed in several patent applications all commonly owned. These applications include U.S. patent application Ser. No. 17/688,265 entitled "Indexer and method of use thereof"; U.S. patent application Ser. No. 17/685,552 entitled "Indexer and method of use thereof"; U.S. patent application Ser. No. 18/238,935 entitled "Auto-indexing lance positioner apparatus and system"; and U.S. patent application Ser. No. 17/959,237 entitled "Flexible Lance Drive Apparatus with Autostroke Function." The entire disclosures of all of these applications are incorporated herein by reference.

Having thus described the general configurations of the system 10, reference is now made to some particular operational and computational aspects thereof. Aspects of the present disclosure pertain to the manners and methods to control the system 10 through the use of the controller 14 utilizing various protocols, and the operation thereof. According to one particular embodiment of the present disclosure, the controller has an operating system installed thereon that may receive manual inputs from an operator, may perform a fully automated operation of the system, or a hybrid approach. In one particular embodiment, an exemplary operating system is commercially known as the "Sentinel OS" offered by the Applicant. Yet, it is to be understood that this operating system is merely exemplary and other operating systems are capable of being used. The operator may interact with the operating system through a display and inputs on the controller 14.

Figure 2:
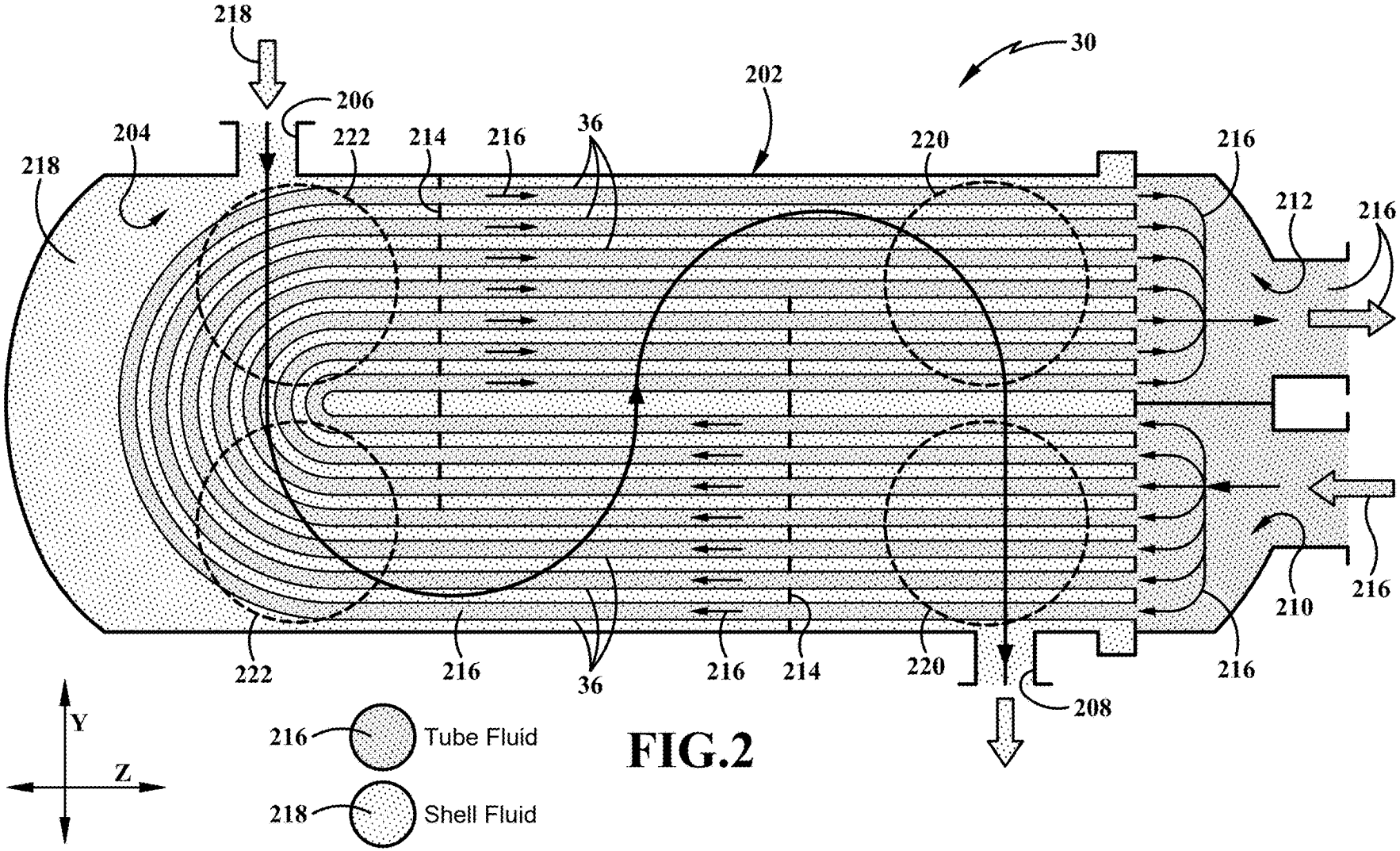
FIG. 2 is a schematic view of an exemplary heat exchanger that is cleaned in accordance with the present disclosure.

FIG. 2 depicts an exemplary operation of the system 10 in which the cleaning device 12 is used to clean the tubes 36 in the heat exchanger 30. In the shown example of FIG. 2, the heat exchanger 30 is a shell and tube heat exchanger. These shell and tube heat exchangers are widely used in various industries for efficient heat transfer between two fluids. This shell and tube heat exchanger includes a shell 202 (i.e., a large pressure vessel) defining an internal volume 204 with a bundle of tubes 36 inside it. One fluid flows through the tubes 36, while another fluid flows over the tubes (through the shell within the volume 204) between an inlet 206 and an outlet 208 in order to transfer heat between the two fluids. The heat exchanger may typically include an inlet plenum 210 and an outlet plenum 212 that is in fluid communication with the tubes 36. Further, the heat exchanger may include one or more baffles that 214 within the inner volume 204 of the shell 202. In a typical shell and tube heat exchanger, the fluid in the tubes 36 (tube-side fluid) and the fluid in the shell 202 (shell-side fluid) are separated by the tube walls. Heat transfer occurs across these walls as the fluids pass through the heat exchanger 30.

The tube-side fluid 216 enters the tubes 36 at the inlet plenum 210 and moves through the tubes 36 until the tube fluid 216 exits the outlet plenum 212. The shell fluid 218 enters the shell inlet 206 and moves through the inner volume 204 and exits the shell outlet 208. As the tube-side fluid 216 flows through the tubes 36, it exchanges heat with the tube walls. The heat is then conducted through the tube material and transferred to the shell-side fluid 218 via convection. The shell-side fluid flows over the tubes, absorbing or releasing heat in the process (e.g., depending on whether tube fluid 216 is desired to be heated or cooled). The temperature of the tube-side fluid 216 decreases if it is the hot fluid and increases if it is the cold fluid. The opposite occurs for the shell-side fluid 218. This temperature change is a direct result of the heat transfer process, where thermal energy is transferred from the hotter fluid to the cooler fluid. The fluids 216, 218 exit the heat exchanger at their respective outlets 212, 208, with the outlet temperatures being different from their inlet temperatures due to the heat transfer that has occurred.

Several factors influence the efficiency of heat transfer in a shell and tube heat exchanger. For example, temperature gradient is the difference in temperature between the two fluids 216, 218 and significantly affects the rate of heat transfer. Additionally, the flow arrangement includes the heat transfer, wherein common flow configurations include counterflow, parallel flow, and crossflow (notably, counterflow, where the fluids flow in opposite directions, generally provides the highest efficiency). Further, the heat transfer surface area, determined by the number and size of tubes, influences the exchanger's capacity to transfer heat, as well as the viscosity, thermal conductivity, and specific heat capacity of the fluids 216, 218 impacts in the heat transfer process.

In shell and tube heat exchangers, maintaining clean inner surfaces of the tubes 36 is beneficial for efficient heat transfer. However, the fluid 216 flowing through the tubes 36 can carry impurities that lead to fouling, or the buildup of unwanted material on the inner surfaces of the tubes. This fouling is influenced by the temperature gradient experienced by different sections or portions of the tubes 36.

Fouling occurs when the fluid 216 moving through the tubes 36 contains impurities, such as dissolved solids, suspended particles, or biological matter. As these impurities come into contact with the inner surfaces of tubes 36, the impurities can adhere to the inner surface of tubes 36 and form deposits. The nature and extent of fouling depend on several factors, including the temperature of the fluid 216, the composition of the impurities, and the flow velocity.

The temperature gradient may cause the tubes 36 to have hotter regions or portion and cooler regions or portions. In the hotter regions of the tubes 36, the fluid 216 temperature is higher, which can cause dissolved solids to precipitate out of the fluid 216. For example, minerals like calcium and magnesium can become less soluble at higher temperatures, leading to scale formation. Additionally, higher temperatures can promote the decomposition of organic matter, resulting in sticky residues that adhere to the inner surface of tubes 36. This accumulation of deposits (e.g., "gunk") can significantly reduce heat transfer efficiency.

In the cooler regions of the tubes 36, the fluid 216 temperature is lower, which tends to keep impurities dissolved or suspended in the fluid 216. As a result, these regions or portions often remain cleaner, with fewer deposits forming on the inner surfaces of tubes 36. The lower temperature reduces the likelihood of precipitation and decomposition, contributing to a cleaner inner surface.

With continued reference to the temperature gradient and deposit formation, at higher temperatures, the solubility of certain minerals, such as calcium carbonate ($CaCO_3$) and magnesium carbonate ($MgCO_3$), decreases. When the tube-side fluid 216 is heated, these minerals precipitate out of the solution and form solid deposits on the inner surfaces of the tubes 36. This process is known as scaling, and it is more pronounced in regions where the fluid temperature is highest. In cooling water systems, calcium carbonate scaling is a common issue. As the cooling water is heated in the tubes, calcium carbonate precipitates out and forms hard, crystalline deposits on the tube surfaces. These deposits can be difficult to remove and significantly reduce heat transfer efficiency.

Similar to minerals, organic matter present in the fluid 216 can undergo thermal decomposition at elevated temperatures. This decomposition results in the formation of sticky residues, which adhere to the inner surface of tubes 36. For instance, in crude oil processing, asphaltenes and other heavy hydrocarbons can decompose and form deposits, leading to significant fouling in the hottest sections of the tubes 36. These deposits form a thick, tar-like layer that reduces the effective heat transfer area and increases the resistance to fluid flow.

Still further, certain chemical compounds in the fluid 216 can undergo polymerization or oxidation at high temperatures, forming complex and often viscous deposits. For example, in the petrochemical industry, ethylene glycol can polymerize at elevated temperatures, leading to fouling in heat exchangers used for ethylene production.

In geothermal power plants, silica scaling can occur when silica-rich geothermal fluid is heated. Silica deposits form on the tube surfaces, creating a hard, glass-like layer that is challenging to remove and can cause severe performance degradation.

In systems where water is used as the heat transfer fluid (i.e., tube fluid 216), dissolved iron can oxidize at high temperatures to form iron oxide deposits. These rust-like deposits adhere to the inner surface of tubes 36, reducing heat transfer efficiency and increasing the risk of corrosion.

Fouling in the tubes 36 can lead to several negative consequences. Namely, deposits act as thermal insulators, reducing the effective heat transfer between the fluid and the tube walls. This can lead to a decrease in the overall performance of the heat exchanger. Further, the buildup of deposits narrows the flow passage, increasing the resistance to fluid flow and causing a higher pressure. This can affect the operational efficiency and increase energy consumption.

To minimize fouling, an operator of the heat exchange may employ several strategies, for example, chemical treatments (e.g., adding scale inhibitors and dispersants to the fluid can help prevent the precipitation of minerals and the formation of deposits), temperature control (e.g., maintaining optimal fluid temperatures can reduce the likelihood of thermal decomposition and scaling), or material section (e.g., using tube materials with high thermal conductivity and resistance to fouling can enhance the heat exchanger's durability and efficiency).

However, even with these minimization efforts, fouling may still occur thereby causing the need to clean the inner surface of the tubes 36. Thus, a cleaning device, such as cleaning device 10, is beneficial to clean the inner surface of the tubes 36.

Aspects of the present disclosure pertain to cleaning techniques that are directed to cleaning the inner surface of the tubes 36 in a manner that considers or accounts for these different hot regions and cool regions. Namely, given the tendency for fouling to occur in the hotter regions 220 of the tubes, the cleaning techniques provide for a variable/dynamic feeding profile or feed rate of the cleaning lances through the tubes 36. Stated otherwise, the cleaning device 10 will feed the lance(s) at a slower rate in the hotter regions 220 where there is a greater likelihood of deposits, due to fouling, on the inner surface of the tubes 36. Feeding the cleaning lance(s) at a slower rate in the hotter region 220 allows the cleaning fluid to be ejected from the lance toward the inner surface of the tubes 36 for a longer period of time than if the lance were fed at a faster rate through the tube 36. The cleaning device 10 will feed the lance(s) at a faster rate in the cooler regions 222 where there is a lower likelihood of deposits, due to fouling, on the inner surface of the tubes 36.

To identify the hotter and cooler regions 220, 222 in the heat exchanger 30, the operator can use a variety of different methods or techniques. For example, there may be thermocouples or temperature sensors installed at various points along the length of the tubes 36 and the shell 202. These sensors may provide real-time data on the temperature of the fluid at different locations. By analyzing this data, operators can determine which regions are hotter and which are cooler. In another example, infrared cameras can be used to capture thermal images of the heat exchanger. These images provide a visual representation of temperature distribution. The thermal images can be analyzed to identify areas with higher temperatures (hot spots) and areas with lower temperatures (cold spots). In yet another example, Computational Fluid Dynamics (CFD) simulations can simulate the heat transfer and fluid flow within the heat exchanger. By creating a detailed model, operators can predict temperature distribution and identify hot and cold regions. In yet another example, temperature profiling may be performed by monitoring the inlet 206 and the outlet 208 of the shell 202 and monitoring the inlet 210 and the outlet 212 of tubes 36. By monitoring, either continuously or periodically, the temperatures at the inlet and outlet of the tubes and the shell, operators can infer temperature gradients along the length of the heat exchanger 30. In yet another example, heat flux sensors can be attached to the outer surface of the tubes 36 to measure the rate of heat transfer at different points. By analyzing the heat flux data, operators can identify variations in heat transfer rates and correlate them with temperature variations within the heat exchanger. In yet another example, Distributed Temperature Sensing (DTS) systems can use fiber optic cables embedded along the length of the tubes or shell. These cables measure temperature continuously over their entire length. In yet another example, ultrasonic sensors measure temperature by detecting changes in the speed of sound as it travels through the fluid. This technique can be used to monitor temperature variations along the length of the tubes. Although the foregoing examples are discussed, it is to be understood that any technique to identify the hotter and cooler regions in the heat exchanger 30 could be used.

Once the hotter and cooler regions 220, 222 have been identified, these regions 220, 222 can be input into a computer application product or software protocol. From these identified regions 220, 222, the computer application product or software protocol will generate an optimized feeding rate profile as an instruction for execution by one or more processors in the controller 14 or another computer of the system 10.

The optimized variable feeding rate will cause the cleaning lances to move slower at the hotter regions 220 of tubes 36 and cause the lances to move faster at the cooler regions 222 of the tubes 36. Collectively, this will cause the cleaning of the inner surfaces of the tubes 36. This is in stark contrast to conventional techniques that feed the lances at a uniform feed rate through the length of the tubes. The uniform feed rate is problematic because it tends to "over-clean" the cooler regions 222 of the tubes 36 (e.g., spending too long in the cooler regions that do not need as much cleaning) and "under-clean" the warmer regions 220 of the tubes 36 (e.g., spending not enough time in the warmer regions that need more cleaning due to more fouling). Thus, utilizing a uniform feed rate of the lances may not fully clean the inner surface of the tubes 36 in the most efficient or optimized manner.

Understanding the temperature distribution helps operators or the computer protocol optimize the feed rates for cleaning operations. In one particular embodiment, once the hotter regions 220 and cooler regions 222 within the shell and tube heat exchanger 30 have been identified, the cleaning lance is an effective tool for cleaning the fouling from the internal surfaces of the tubes 36.

Prior to inserting the lance, the heat exchanger 30 should be taken offline/shut down, and access points to the tubes 36 are opened or exposed. The lance with the cleaning nozzle is prepared for insertion into the tubes 36. The lance may be designed to navigate the bends and length of the tubes 36.

The lance can be manually controlled by an operator or automated using a control system, such as controller 14, to navigate through the tubes.

The feeding rate of the lance can be adjusted based on the identified hotter regions 220 and cooler regions 222 to optimize the cleaning process. The temperature data, such as from thermocouples, infrared thermography, or other techniques discussed herein is integrated into the controller 14. This mapping identifies the locations of hot and cold regions within the tubes 36. The control system may be programmed with algorithms that use the temperature data to adjust the lance's feed rate dynamically.

With respect to the adjustment of the lance feed rate, in regions identified as hot spots (i.e., hotter regions 220), the feed rate of the lance is slowed down. This allows the cleaning nozzle to spend more time (i.e., a greater period of time) ejecting cleaning fluid from the nozzle in these areas to fully clean the fouling and deposit accumulation. In cooler regions 222, where fouling is less likely, the feed rate of the lance is increased. This reduces the cleaning time in areas that are less likely to be as dirty as the hotter regions 220. Faster movement through cooler regions 222 allows the cleaning process to be more time-efficient, focusing those cleaning resources on areas that require more attention.

The controller 14 may continuously monitor the cleaning and temperature data, making real-time adjustments to the feed rate as the cleaning progresses. The cleaning data, which may include video footage, lance nozzle data, and/or temperature readings, may be recorded for further analysis and documentation.

Controlling the feed rate of the cleaning lance to provide slower feeding in the hotter regions 220 and faster feeding in the cooler regions 222 may be accomplished by a variety of different control logics, techniques, or algorithms. These control logics, techniques or algorithms ensure that the cleaning process is optimized by spending more time in hotter regions 220 (where fouling is more likely) and less time in cooler regions 222.

In one example, the control logics, techniques, or algorithms can be implemented by a Proportional-Integral-Derivative (PID) Control. PID control is an algorithm that adjusts the feed rate based on the error between the desired temperature and the actual temperature. The PID controller may include at least three components (i) Proportional (P), (ii) Integral (I), and (iii) Derivative (D). The P component adjusts the feed rate proportionally to the temperature error. A higher error results in a larger adjustment. The I component accounts for the accumulated error over time, helping to eliminate steady-state errors. The D component predicts future errors based on the rate of change of the temperature error, providing a damping effect. The PID control algorithm can be tuned to prioritize cleaning in hotter regions 220 by adjusting the proportional gain to be more sensitive to higher temperature errors.

In one example, the control logics, techniques, or algorithms can be implemented by a feedforward control. Feedforward control uses a model of the system to predict the required feed rate adjustments based on the temperature data. This method anticipates changes in temperature and adjusts the feed rate proactively. The control algorithm can be designed to slow down the feed rate when approaching hotter regions 220 and speed it up (i.e., increase) in cooler regions 222.

In another example, the control logics, techniques, or algorithms can be implemented by a Model Predictive Control (MPC). MPC is an advanced control algorithm that uses a mathematical model of the heat exchanger to predict future temperature distributions and optimize the feed rate of the cleaning lance accordingly. The algorithm considers constraints such as maximum and minimum feed rates and aims to minimize fouling cleaning time while ensuring thorough total cleaning.

In another example, the control logics, techniques, or algorithms can be implemented by adaptive control. Adaptive control algorithms adjust the control parameters in real-time based on the observed temperature data. These algorithms can learn from the cleaning process and dynamically update the feed rate to optimize the cleaning in different temperature regions.

In another example, the control logics, techniques, or algorithms can be implemented by fuzzy logic control. Fuzzy logic control uses fuzzy sets and rules to handle the uncertainty and variability in temperature data. The algorithm can be designed with rules that adjust the feed rate based on the degree of "hotness" or "coolness" of the regions. For example, if the temperature is "very hot," the feed rate is reduced significantly.

In another example, the control logics, techniques, or algorithms can be implemented by a neural network control. Neural network control uses artificial neural networks to model the relationship between temperature data and optimal feed rates for cleaning the tubes. The neural network can be trained on historical inspection or cleaning data to learn the best feed rate adjustments for different temperature regions.

Although the primary consideration of the dynamically adjustable feed rate has been referenced herein for cleaning operations, it is also possible to utilize this technology for visual inspection purposes. For example, a flexible lance equipped with a high-resolution camera at its end may be prepared for insertion into the tubes. The lance is designed to navigate the bends and length of the tubes. The camera may provide a real-time video feed to the operator, allowing for immediate visual inspection of the tube's internal surfaces. Integrated lighting on the camera may be provided to ensure clear visibility, even in low-light conditions inside the tubes. The lance can be manually controlled by an operator or automated using a control system to navigate through the tubes. The feeding rate of the lance can be adjusted based on the identified hot and cold regions to optimize the inspection process. To enhance the efficiency and effectiveness of the inspection process, the control system can adjust the feed rate of the lance-mounted camera according to the temperature regions. The temperature data from thermocouples, infrared thermography, or other methods is integrated into the control system. This mapping identifies the precise locations of hot and cold regions within the tubes. The control system is programmed with algorithms that use the temperature data to adjust the lance's feed rate dynamically. In regions identified as hot spots, the feed rate of the lance is slowed down. This allows the camera to spend more time inspecting these areas, providing a detailed assessment of fouling and deposit accumulation. By spending more time in hot regions, the operator can capture high-quality images and video, ensuring thorough inspection of potential problem areas. In cooler regions, where fouling is less likely, the feed rate of the lance is increased. This reduces the inspection time in areas that are less critical. Faster movement through cooler regions allows the inspection process to be more time-efficient, focusing resources on areas that require more attention. The control system may continuously monitor the camera feed and temperature data, making real-time adjustments to the feed rate as the inspection progresses. All inspection data, including video footage and temperature readings, are recorded for further analysis and documentation.

The inspection and cleaning process may occur simultaneously. For example, a first lance may be carried by the indexer or positioner and perform the cleaning function utilizing the optimized feeding rate detailed herein. Then, a second lance may carry the camera or other inspection device (such as an electric or magnetic sensor). After the first lance has performed the cleaning, the indexer may move or shift the two lances over by one tube. Then, the second lance can be inserted into that same tube to perform the inspection procedure. Thus, this embodiment provides where a first lance is a cleaning lance and the second lance is an inspection lance.

Figure 3:
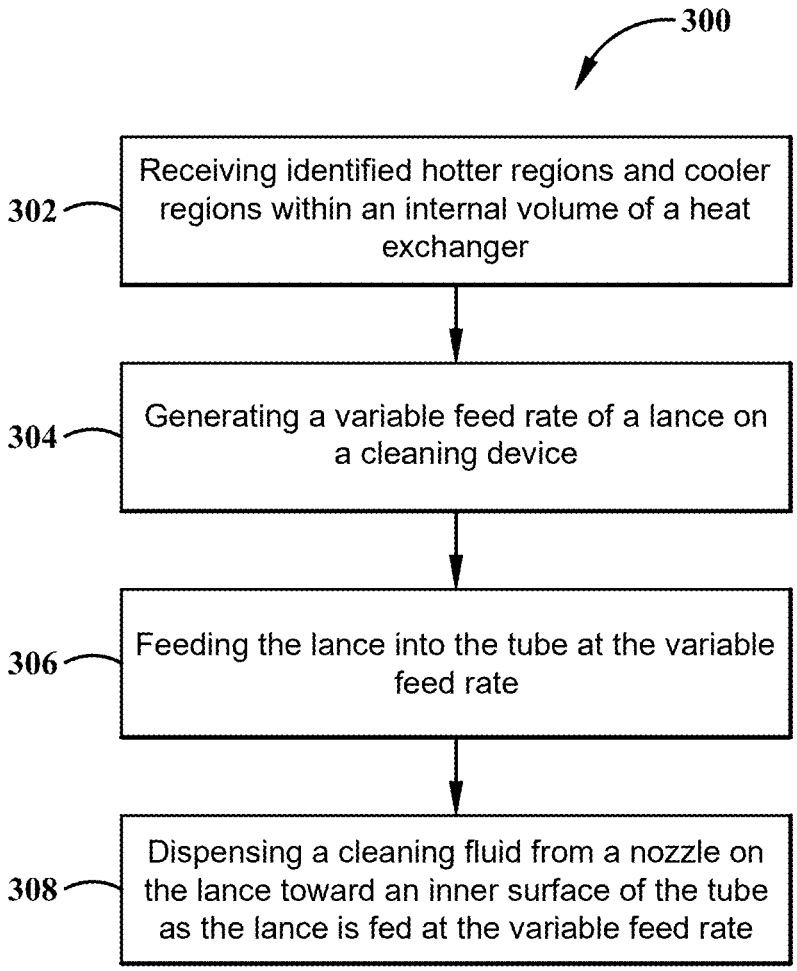
FIG. 3 is a flow chart depicting an exemplary method of cleaning a heat exchanger.

FIG. 3 is a flowchart that identifies an exemplary method or process of the present disclosure, shown generally at 300. Method 300 includes receiving identified hotter regions and cooler regions within an internal volume of a heat exchanger, wherein there is more fouling on an inner surface of a tube within the heat exchanger in the hotter regions and less fouling on the inner surface of the tube in the cooler regions, which is shown generally at 302. Method 300 includes generating a variable feed rate of a lance on a cleaning device, wherein the variable feed rate is based on the hotter regions and the cooler regions, and wherein the variable feed rate is slower in the hotter regions and faster in the cooler regions, which is shown generally at 304. Method 300 includes feeding the lance into the tube at the variable feed rate, which is shown generally at 306. Method 300 includes dispensing a cleaning fluid from a nozzle on the lance toward an inner surface of the tube as the lance is fed at the variable feed rate, wherein the cleaning fluid contacts the inner surface of the tube to clean the fouling therefrom, which is shown generally at 308.

This method 300 may also be implemented as a computer program product or software. Thus, the present disclosure also encompasses a computer program product including at least one non-transitory machine-readable medium encoded with instructions that when executed by one or more processors cause a process for cleaning device to feed a lance into a tube in a heat exchanger at a variable feed rate dependent on temperatures of different portions of the tube, the instructions comprising: receive identified hotter regions and cooler regions within an internal volume of the heat exchanger, wherein there is more fouling on an inner surface of the tube in the hotter regions and less fouling on the inner surface of the tube in the cooler regions; generate the variable feed rate of the lance based on the hotter regions and the cooler regions, wherein the variable feed rate is slower in the hotter regions and faster in the cooler regions; feed the lance into the tube at the variable feed rate; and dispense a cleaning fluid from a nozzle on the lance toward an inner surface of the tube as the lance is fed at the variable feed rate, wherein the cleaning fluid contacts the inner surface of the tube to clean the fouling therefrom The device, assembly, or system 10 of the present disclosure may additionally include one or more sensors to sense or gather data pertaining to the surrounding environment or operation of the device, assembly, or system 10. Some exemplary sensors capable of being electronically coupled with the device, assembly, or system of the present disclosure (either directly connected to the device, assembly, or system of the present disclosure or remotely connected thereto) may include but are not limited to: accelerometers sensing accelerations experienced during rotation, translation, velocity/speed, location traveled, elevation gained; gyroscopes sensing movements during angular orientation and/or rotation, and rotation; altimeters sensing barometric pressure, altitude change, terrain climbed, local pressure changes, submersion in liquid; impellers measuring the amount of fluid passing thereby; global positioning sensors sensing location, elevation, distance traveled, velocity/speed; audio sensors sensing local environmental sound levels, or voice detection; photo/light sensors sensing ambient light intensity, ambient, day/night, UV exposure; TV/IR sensors sensing light wavelength; temperature sensors sensing machine or motor temperature, ambient air temperature, and environmental temperature; radar sensors; lidar sensors; ultrasonic sensors; magnetic sensors, image sensors; and moisture sensors sensing surrounding moisture levels.

If sensors are utilized to gather data relating to the device, assembly, or system 10 of the present disclosure, then sensed data may be evaluated and processed with artificial intelligence (AI). Analyzing data gathered from sensors using artificial intelligence involves the process of extracting meaningful insights and patterns from raw sensor data to produce refined and actionable results. Raw data is gathered from various sensors, for example those which have been identified herein or others, capturing relevant information based on the intended analysis. This data is then preprocessed to clean, organize, and structure it for effective analysis. Features that represent key characteristics or attributes of the data are extracted. These features serve as inputs for AI algorithms, encapsulating relevant information essential for the analysis. A suitable AI model, such as machine learning or deep learning (regardless of whether it is supervised or unsupervised), is chosen based on the nature of the data and the desired analysis outcome. The model is then trained using labeled or unlabeled data to learn the underlying patterns and relationships. The model is fine-tuned and optimized to enhance its performance and accuracy. This process involves adjusting parameters, architectures, and algorithms to achieve better results. The trained model is used to make predictions or inferences on new, unseen data. The model processes the extracted features and generates refined output based on the patterns it has learned during training. The results produced by the AI model are refined through post-processing techniques to ensure accuracy and relevance. These refined results are then interpreted to extract meaningful insights and derive actionable conclusions. Feedback from the refined results is used to improve the AI model iteratively. The process involves incorporating new data, adjusting the model, and enhancing the analysis based on real-world feedback and evolving requirements. Further, AI results can be used to alter the operation of the device, assembly, or system of the present disclosure based on feedback. For example, AI feedback can be used to improve the efficiency of the device, assembly, or system of the present disclosure by responding to predicted changes in the environment or predicted changes to the device, assembly, or system of the present disclosure more quickly than if only sensed by one or more of the sensors.

A sensor model may be employed, once trained, in the device, assembly, or system 10 of the present disclosure. In one embodiment, the device, assembly, or system of the present disclosure can be used to teach a sensor model to predict sensor data for a specific scenario. Alternatively, sensor models can be utilized to generate the data to train the AI. The sensor model can be trained for any type of sensor, such as those types of sensors described above, and/or other sensor types. The elements described herein may be implemented as discrete or distributed components in any suitable combination and location. The various functions described herein may be conducted by hardware, firmware, and/or software. For example, a processor may perform various functions by executing instructions stored in memory.

The AI model and/or sensor model can include a deep neural network (DNN), convolutional neural network (CNN), another neural network (NN) or the like and can support generative learning. For example, the sensor model can include a generative adversarial network (GAN), a variational autoencoder (VAE), and/or another type of DNN, CNN, NN or machine learning model (e.g., natural language processing (NLP)). Generally, the sensor model can accept some encoded representation of a scene as input using any number of data structures and/or channels (e.g., concatenated vectors, matrices, tensors, images, etc.).

In a particular embodiment, the device, assembly, or system of the present disclosure can use the sensors to acquire a representation of the real-world environment (e.g., a physical environment) at a given point in time. Data from these sensors may be used to generate a representation of a scene or scenario, which may then be used to teach a sensor model. For example, a representation of a scene to the tubes 36 in the tube bundle can be derived from sensor data, properties of objects in the scene or surrounding environment such as positions or dimensions (e.g., tubesheet maps), classification data identifying tubes (i.e., cleaned vs. uncleanded) in the scene or surrounding environment, properties or classification data of components of the device, assembly, or system of the present disclosure, or some combination thereof. Generally, the sensor model learns to predict sensor data from a representation of the scene, environment or operation of the device, assembly, or system 10 of the present disclosure.

The sensor model architecture can be selected to fit the shape of the desired input and output data. Examples of architectures (e.g., DNNs) include, but are not limited to, perceptron, feed-forward, radial basis, deep feed-forward, recurrent, long/short term memory, gated recurrent unit, autoencoder, variational autoencoder, convolutional, deconvolutional, and generative adversarial. Some DNN architectures, such as a GAN, can include a convolutional neural network (CNN) that accepts and evaluates an input image and may include multiple input channels, which may be used to accept and evaluate multiple input images and/or input vectors.

In one embodiment, training data for the sensor model may be generated using real-world (e.g., physical environment tubesheet or tube configuration) data. To collect real-world training data, the device, assembly, or system 10 of the present disclosure may collect sensor data by fusing sensors as the vehicle traverses a real-world environment. The sensors of the device, assembly, or system 10 of the present disclosure may include, for example, one or more global navigation satellite systems sensors (e.g., Global Positioning System sensors (GPS)), RADAR sensors, ultrasonic sensors, LIDAR sensors, inertial measurement unit (IMU) sensors (e.g., accelerometer(s), gyroscope(s), magnetic compass(es), magnetometer(s), etc.), ego-motion sensors, microphones, stereo cameras, wide-view cameras (e.g., fisheye cameras), infrared cameras, surround cameras (e.g., 360 degree cameras), long-range and/or mid-range cameras, speed sensors (e.g., for measuring the speed of the vehicle), vibration sensors, steering sensors, brake sensors (e.g., as part of the brake sensor system), and/or other sensor types.

In another embodiment, training data for the sensor model is generated based on simulated or virtual environments. The training data may then be used to train the sensor model for use in real-world autonomous applications, e.g., to control the operation of the device, assembly, or system 10 of the present disclosure. The training data may be derived to fit the shape of the input and output data for the sensor model, which may depend on the architecture of the sensor model. For example, sensor data may be used to encode an input scene, input parameters, and/or ground truth sensor data using different data structures and/or channels (e.g., concatenated vectors, matrices, tensors, images, etc.).

The device, assembly, or system of the present disclosure may include hardware, software and/or firmware responsible for managing the sensor data generated by the sensors. The autonomous hardware, software, and/or firmware being executed may manage different environments using one or more maps (e.g., tubesheet layouts), positioning component(s), and the like. The autonomous hardware, software, and/or firmware may also include components to plan, control, and generally manage the device, assembly, or system of the present disclosure. In one example, the autonomous hardware, software, and/or firmware can be installed in and used to control the device, assembly, or system of the present disclosure through the environment based on the sensor data, one or more machine learning models (e.g., neural networks), and the like. A training system may use the training data to train the sensor model to predict virtual sensor data for a given scene, environment, or operation of a component.

The training system can include one or more servers (e.g., a graphics processing unit server) and data stores and may use a cloud-based deep learning infrastructure with artificial intelligence to analyze the sensor data received from the device, assembly, or system of the present disclosure and/or stored in the data store. The training system can also incorporate or train up-to-date, real-time neural networks (and/or other machine learning models) for one or more sensor models.

The device, assembly, or system of the present disclosure may include wireless communication logic coupled to sensors on the device, assembly, or system. The sensors gather data and provide the data to the wireless communication logic. Then, the wireless communication logic may transmit the data gathered from the sensors to a remote device. Thus, the wireless communication logic may be part of a broader communication system, in which one or several devices, assemblies, or systems of the present disclosure may be networked together to report alerts and, more generally, to be accessed and controlled remotely. Depending on the types of transceivers installed in the device, assembly, or system of the present disclosure, the system may use a variety of protocols (e.g., Wi-Fi©, ZigBee©, MIWI, BLUETOOTH©) for communication. In one example, each of the devices, assemblies, or systems of the present disclosure may have its own IP address and may communicate directly with a router or gateway. This would typically be the case if the communication protocol is Wi-Fi©. (Wi-Fi© is a registered trademark of Wi-Fi Alliance of Austin, TX, USA; ZigBee© is a registered trademark of ZigBee Alliance of Davis, CA, USA; and BLUETOOTH© is a registered trademark of Bluetooth Sig, Inc. of Kirkland, WA, USA).

In another example, a point-to-point communication protocol like MiWi or ZigBee® is used. One or more of the device, assembly, or system of the present disclosure may serve as a repeater, or the devices, assemblies, or systems of the present disclosure may be connected together in a mesh network to relay signals from one device, assembly, or system to the next. However, the individual device, assembly, or system in this scheme typically would not have IP addresses of their own. Instead, one or more of the devices, assemblies, or system of the present disclosure communicates with a repeater that does have an IP address, or another type of address, identifier, or credential needed to communicate with an outside network. The repeater communicates with the router or gateway.

In either communication scheme, the router or gateway communicates with a communication network, such as the Internet, although in some embodiments, the communication network may be a private network that uses transmission control protocol/internet protocol (TCP/IP) and other common Internet protocols but does not interface with the broader Internet, or does so only selectively through a firewall.

The system that receives and processes signals from the device, assembly, or system of the present disclosure may differ from embodiment to embodiment. In one embodiment, alerts and signals from the device, assembly, or system of the present disclosure are sent through an e-mail or simple message service (SMS; text message) gateway so that they can be sent as e-mails or SMS text messages to a remote device, such as a smartphone, laptop, or tablet computer, monitored by a responsible individual, group of individuals, or department, such as a maintenance department. Thus, if a particular device, assembly, or system 10 of the present disclosure creates an alert because of a data point gathered by one or more sensors, that alert can be sent, in e-mail or SMS form, directly to the individual responsible for resolving it. Of course, e-mail and SMS are only two examples of communication methods that may be used; in other embodiments, different forms of communication may be used.

As described herein, aspects of the present disclosure may include one or more electrical, pneumatic, hydraulic, or other similar secondary components and/or systems therein. The present disclosure is therefore contemplated and will be understood to include any necessary operational components thereof. For example, electrical components will be understood to include any suitable and necessary wiring, fuses, or the like for normal operation thereof. Similarly, any pneumatic systems provided may include any secondary or peripheral components such as air hoses, compressors, valves, meters, or the like. It will be further understood that any connections between various components not explicitly described herein may be made through any suitable means including mechanical fasteners, or more permanent attachment means, such as welding or the like. Alternatively, where feasible and/or desirable, various components of the present disclosure may be integrally formed as a single unit.

Unless explicitly stated that a particular shape or configuration of a component is mandatory, any of the elements, components, or structures discussed herein may take the form of any shape. Thus, although the figures depict the various elements, components, or structures of the present disclosure according to one or more exemplary embodiments, it is to be understood that any other geometric configuration of that element, component, or structure is entirely possible. For example, instead of the tubes being arranged in a square or triangular configuration, that tube configuration may be any semi-circular, triangular, rectangular or square, pentagonal, hexagonal, heptagonal, octagonal, decagonal, dodecagonal, diamond shaped or another parallelogram, trapezoidal, star-shaped, oval, ovoid, lines or lined, teardrop-shaped, cross-shaped, donut-shaped, heart-shaped, arrow-shaped, crescent-shaped, any letter shape (i.e., A-shaped, B-shaped, C-shaped, D-shaped, E-shaped, F-shaped, G-shaped, H-shaped, I-shaped, J-shaped, K-shaped, L-shaped, M-shaped, N-shaped, O-shaped, P-shaped, Q-shaped, R-shaped, S-shaped, T-shaped, U-shaped, V-shaped, W-shaped, X-shaped, Y-shaped, or Z-shaped), or any other type of regular or irregular, symmetrical or asymmetrical configuration.

Various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

Any flowchart and/or block diagrams in the Figures illustrate some exemplary architecture, functionality, and operation of possible implementations of systems, methods, and computer program products according to various embodiments of the present disclosure. In this regard, each block in the flowchart or block diagrams may represent a module, segment, or portion of instructions, which comprises one or more executable instructions for implementing the specified logical function(s). In some alternative implementations, the functions noted in the blocks may occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

The above-described embodiments can be implemented in any of numerous ways. For example, embodiments of technology disclosed herein may be implemented using hardware, software, firmware or a combination thereof. When implemented in software, the software code or instructions can be executed on any suitable processor or collection of processors, whether provided in a single computer or distributed among multiple computers or in firmware. Furthermore, the instructions or software code can be stored in at least one non-transitory computer readable storage medium.

Also, a computer or smartphone may be utilized to execute the software code or instructions via its processors may have one or more input and output devices. These devices can be used, among other things, to present a user interface. Examples of output devices that can be used to provide a user interface include printers or display screens for visual presentation of output and speakers or other sound generating devices for audible presentation of output. Examples of input devices that can be used for a user interface include keyboards, and pointing devices, such as mice, touch pads, and digitizing tablets. As another example, a computer may receive input information through speech recognition or in other audible format.

Such computers or smartphones may be interconnected by one or more networks in any suitable form, including a local area network or a wide area network, such as an enterprise network, and intelligent network (IN) or the Internet. Such networks may be based on any suitable technology and may operate according to any suitable protocol and may include wireless networks, wired networks or fiber optic networks.

The various methods or processes outlined herein may be coded as software/instructions that are executable on one or more processors that employ any one of a variety of operating systems or platforms. Additionally, such software may be written using any of a number of suitable programming languages and/or programming or scripting tools, and also may be compiled as executable machine language code or intermediate code that is executed on a framework or virtual machine.

In this respect, various inventive concepts may be embodied as a computer readable storage medium (or multiple computer readable storage media) (e.g., a computer memory, one or more floppy discs, compact discs, optical discs, magnetic tapes, flash memories, USB flash drives, SD cards, circuit configurations in Field Programmable Gate Arrays or other semiconductor devices, or other non-transitory medium or tangible computer storage medium) encoded with one or more programs that, when executed on one or more computers or other processors, perform methods that implement the various embodiments of the disclosure discussed above. The computer readable medium or media can be transportable, such that the program or programs stored thereon can be loaded onto one or more different computers or other processors to implement various aspects of the present disclosure as discussed above.

The terms "program" or "software" or "instructions" are used herein in a generic sense to refer to any type of computer code or set of computer-executable instructions that can be employed to program a computer or other processor to implement various aspects of embodiments as discussed above. Additionally, it should be appreciated that according to one aspect, one or more computer programs that when executed perform methods of the present disclosure need not reside on a single computer or processor but may be distributed in a modular fashion amongst a number of different computers or processors to implement various aspects of the present disclosure.

Computer-executable instructions may be in many forms, such as program modules, executed by one or more computers or other devices. Generally, program modules include routines, programs, objects, components, data structures, etc. that perform particular tasks or implement particular abstract data types. Typically, the functionality of the program modules may be combined or distributed as desired in various embodiments. As such, one aspect or embodiment of the present disclosure may be a computer program product including least one non-transitory computer readable storage medium in operative communication with a processor, the storage medium having instructions stored thereon that, when executed by the processor, implement a method or process described herein, wherein the instructions comprise the steps to perform the method(s) or process(es) detailed herein.

Also, data structures may be stored in computer-readable media in any suitable form. For simplicity of illustration, data structures may be shown to have fields that are related through location in the data structure. Such relationships may likewise be achieved by assigning storage for the fields with locations in a computer-readable medium that convey relationship between the fields. However, any suitable mechanism may be used to establish a relationship between information in fields of a data structure, including through the use of pointers, tags or other mechanisms that establish relationship between data elements.

All definitions, as defined and used herein, should be understood to control over dictionary definitions, definitions in documents incorporated by reference, and/or ordinary meanings of the defined terms.

"Logic", as used herein, includes but is not limited to hardware, firmware, software, and/or combinations of each to perform a function(s) or an action(s), and/or to cause a function or action from another logic, method, and/or system. For example, based on a desired application or needs, logic may include a software controlled microprocessor, discrete logic like a processor (e.g., microprocessor), an application specific integrated circuit (ASIC), a programmed logic device, a memory device containing instructions, an electric device having a memory, or the like. Logic may include one or more gates, combinations of gates, or other circuit components. Logic may also be fully embodied as software. Where multiple logics are described, it may be possible to incorporate the multiple logics into one physical logic. Similarly, where a single logic is described, it may be possible to distribute that single logic between multiple physical logics.

Furthermore, the logic(s) presented herein for accomplishing various methods of this system may be directed towards improvements in existing computer-centric or internet-centric technology that may not have previous analog versions. The logic(s) may provide specific functionality directly related to structure that addresses and resolves some problems identified herein. The logic(s) may also provide significantly more advantages to solve these problems by providing an exemplary inventive concept as specific logic structure and concordant functionality of the method and system. Furthermore, the logic(s) may also provide specific computer implemented rules that improve existing technological processes. The logic(s) provided herein extends beyond merely gathering data, analyzing the information, and displaying the results. Further, portions or all of the present disclosure may rely on underlying equations that are derived from the specific arrangement of the equipment or components as recited herein. Thus, portions of the present disclosure as it relates to the specific arrangement of the components are not directed to abstract ideas. Furthermore, the present disclosure and the appended claims present teachings that involve more than performance of well-understood, routine, and conventional activities previously known to the industry. In some of the method or process of the present disclosure, which may incorporate some aspects of natural phenomenon, the process or method steps are additional features that are new and useful.

More particularly, the device, assembly, or system of the present disclosure, which may include the logic(s) presented herein, includes the features, components, techniques or processes detailed herein that, as combined, accomplished the desired results detailed herein. These specific elements, configuration or techniques of the device, assembly, or system of the present disclosure, some of which may be included in at least one of the appended claims, accomplish these desired results to overcome the then existing problems in the relevant field of computer processor-based systems. Additionally, the features, components, techniques or processes of the device, assembly, or system of the present disclosure, are an unconventional arrangement of elements or unconventionally perform a method detailed herein that was unavailable without the unconventional arrangement of elements. These exemplary, yet particular, arrangements provide an improvement over existing technologies that have failed to operate in the manner, and with the efficiency that is taught by the device, assembly, or system of the present disclosure.

The articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc. As another example, "at least one of: A, B, or B" is intended to cover A, B, C, A-B, A-C, B-C, and A-B-C, as well as any combination with multiple of the same item.

While components of the present disclosure are described herein in relation to each other, it is possible for one of the components disclosed herein to include inventive subject matter, if claimed alone or used alone. In keeping with the above example, if the disclosed embodiments teach the features of A and B, then there may be inventive subject matter in the combination of A and B, A alone, or B alone, unless otherwise stated herein.

As used herein in the specification and in the claims, the term "effecting" or a phrase or claim element beginning with the term "effecting" should be understood to mean to cause something to happen or to bring something about. For example, effecting an event to occur may be caused by actions of a first party even though a second party actually performed the event or had the event occur to the second party. Stated otherwise, effecting refers to one party giving another party the tools, objects, or resources to cause an event to occur. Thus, in this example a claim element of "effecting an event to occur" would mean that a first party is giving a second party the tools or resources needed for the second party to perform the event, however the affirmative single action is the responsibility of the first party to provide the tools or resources to cause said event to occur.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "above", "behind", "in front of", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal", "lateral", "transverse", "longitudinal", and the like are used herein for the purpose of explanation only unless specifically indicated otherwise.

Although the terms "first" and "second" may be used herein to describe various features/elements, these features/elements should not be limited by these terms, unless the context indicates otherwise. These terms may be used to distinguish one feature/element from another feature/element. Thus, a first feature/element discussed herein could be termed a second feature/element, and similarly, a second feature/element discussed herein could be termed a first feature/element without departing from the teachings of the present disclosure.

An embodiment is an implementation or example of the present disclosure. Reference in the specification to "an embodiment," "one embodiment," "some embodiments," "one particular embodiment," "an exemplary embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," "an exemplary embodiment," or "other embodiments," or the like, are not necessarily all referring to the same embodiments. Furthermore, the use of any and all examples or exemplary language ("e.g.," "such as," or the like) is intended merely to better illustrate or illuminate the embodiments and does not pose a limitation on the scope of that or those embodiments. No language in this specification should be construed as indicating any unclaimed element as essential to the practice of the disclosed embodiment.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element or "another" element, that does not preclude there being more than one of the additional element or the another element.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical range recited herein is intended to include all sub-ranges subsumed therein. Further, recitation of ranges of values herein are not intended to be limiting, referring instead individually to any and all values falling within that range, unless otherwise indicated herein, and each separate value within such range is incorporated into the specification as if it were individually recited herein.

Additionally, the method of performing the present disclosure may occur in a sequence different than those described herein. Accordingly, no sequence of the method should be read as a limitation unless explicitly stated. It is recognizable that performing some of the steps of the method in a different order could achieve a similar result.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively.

To the extent that the present disclosure has utilized the term "invention" in various titles or sections of this specification, or in the context of those sections, this term has been included as required by the formatting requirements of word document submissions (i.e., docx submissions) pursuant the guidelines/requirements of the United States Patent and Trademark Office and shall not, in any manner, be considered a disavowal of any subject matter.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

What is claimed is:

1. A computer program product including at least one non-transitory machine-readable medium encoded with instructions that when executed by one or more processors cause a process for a motor to feed a lance into a tube in a heat exchanger at a variable feed rate dependent on temperatures of different portions of the tube, the instructions comprising:

receive identified hotter regions and cooler regions within an internal volume of the heat exchanger, wherein there is more fouling on an inner surface of the tube in the hotter regions and less fouling on the inner surface of the tube in the cooler regions;

generate the variable feed rate of the lance based on the hotter regions and the cooler regions, wherein the variable feed rate is slower in the hotter regions and faster in the cooler regions;

feed the lance into the tube at the variable feed rate; and dispense a cleaning fluid from a nozzle on the lance toward an inner surface of the tube as the lance is fed at the variable feed rate, wherein the cleaning fluid contacts the inner surface of the tube to clean the fouling therefrom.

2. The computer program product of claim 1, wherein the instructions further comprise:

reduce a period of time during which the cleaning fluid is dispensed in the cooler regions relative to a period of time during which the cleaning fluid is dispensed in the hotter regions.

3. The computer program product of claim 1, wherein the instructions further comprise:

increase a period of time during which the cleaning fluid is dispensed in the hotter regions relative to a period of time during which the cleaning fluid is dispensed in the cooler regions.

4. The computer program product of claim 1, wherein the instructions further comprise:

continuously monitor cleaning and temperature data; and adjust, in real-time, the feed rate as cleaning progresses.

5. The computer program product of claim 1, wherein the instructions further comprise:

map locations of the hotter regions and cooler regions within the tube.

6. The computer program product of claim 1, wherein the instructions further comprise:

control the variable feed rate via a Proportional-Integral-Derivative (PID) control.

7. The computer program product of claim 1, wherein the instructions further comprise:

control the variable feed rate via a feedforward control.

8. The computer program product of claim 1, wherein the instructions further comprise:

control the variable feed rate via a Model Predictive Control (MPC).

9. The computer program product of claim 1, wherein the instructions further comprise:

control the variable feed rate via adaptive control.

10. The computer program product of claim 1, wherein the instructions further comprise:

control the variable feed rate via a fuzzy logic control or a neural network control.

11. A method comprising:

receiving identified hotter regions and cooler regions within an internal volume of a heat exchanger, wherein there is more fouling on an inner surface of a tube within the heat exchanger in the hotter regions and less fouling on the inner surface of the tube in the cooler regions;

generating a variable feed rate for a lance coupled to a controller, wherein the variable feed rate is based on the hotter regions and the cooler regions, and wherein the variable feed rate is slower in the hotter regions and faster in the cooler regions;

feeding the lance into the tube at the variable feed rate; and dispensing a cleaning fluid from a nozzle on the lance toward an inner surface of the tube as the lance is fed at the variable feed rate, wherein the cleaning fluid contacts the inner surface of the tube to clean the fouling therefrom.

12. The method of claim 11, further comprising:

reducing a period of time during which the cleaning fluid is dispensed in the cooler regions relative to a period of time during which the cleaning fluid is dispensed in the hotter regions.

13. The method of claim 11, further comprising:

increasing a period of time during which the cleaning fluid is dispensed in the hotter regions relative to a period of time during which the cleaning fluid is dispensed in the cooler regions.

14. The method of claim 11, further comprising:

continuously monitoring cleaning and temperature data; and adjusting, in real-time, the feed rate as cleaning progresses.

15. The method of claim 11, further comprising:

mapping locations of the hotter regions and cooler regions within the tube.

16. The method of claim 11, further comprising:

controlling the variable feed rate via a Proportional-Integral-Derivative (PID) control.

17. The method of claim 11, further comprising:

controlling the variable feed rate via a feedforward control.

18. The method of claim 11, further comprising:

controlling the variable feed rate via a Model Predictive Control (MPC).

19. The method of claim 11, further comprising:

controlling the variable feed rate via adaptive control.

20. The method of claim 11, further comprising:

controlling the variable feed rate via a fuzzy logic control or a neural network control.

* * * * *